US008515767B2

(12) United States Patent
Reznik

(10) Patent No.: US 8,515,767 B2
(45) Date of Patent: Aug. 20, 2013

(54) TECHNIQUE FOR ENCODING/DECODING OF CODEBOOK INDICES FOR QUANTIZED MDCT SPECTRUM IN SCALABLE SPEECH AND AUDIO CODECS

(75) Inventor: Yuriy Reznik, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1122 days.

(21) Appl. No.: 12/263,726

(22) Filed: Nov. 3, 2008

(65) Prior Publication Data

US 2009/0240491 A1 Sep. 24, 2009

Related U.S. Application Data

(60) Provisional application No. 60/985,263, filed on Nov. 4, 2007.

(51) Int. Cl.

| | |
|---|---|
| ***G10L 19/00*** | (2006.01) |
| ***G10L 21/00*** | (2006.01) |
| ***G10L 19/12*** | (2006.01) |

(52) U.S. Cl.

USPC ..... 704/500; 704/501; 704/502; 704/200; 704/200.1; 704/201; 704/219; 704/221; 704/222; 704/223

(58) Field of Classification Search

USPC ..... 704/200–201, 219, 500–502, 221, 704/222, 223

See application file for complete search history.

(56) References Cited

U.S. PATENT DOCUMENTS

| | | | | |
|---|---|---|---|---|
| 5,602,961 | A * | 2/1997 | Kolesnik et al. | 704/223 |
| 5,729,655 | A * | 3/1998 | Kolesnik et al. | 704/223 |
| 5,970,443 | A * | 10/1999 | Fujii | 704/222 |
| 6,484,142 | B1 * | 11/2002 | Miyasaka et al. | 704/500 |

(Continued)

FOREIGN PATENT DOCUMENTS

| | | | |
|---|---|---|---|
| EP | 1141946 | A1 | 10/2001 |
| EP | 1521243 | A1 | 4/2005 |

(Continued)

OTHER PUBLICATIONS

Minjie Xie; Adoul, J.-P.; , "Embedded algebraic vector quantizers (EAVQ) with application to wideband speech coding," Acoustics, Speech, and Signal Processing, 1996. ICASSP-96. Conference Proceedings., 1996 IEEE International Conference on , vol. 1, No., pp. 240-243 vol. 1, May 7-10, 1996.*

(Continued)

*Primary Examiner* — Edgar Guerra-Erazo
(74) *Attorney, Agent, or Firm* — Espartaco Diaz Hidalgo

(57) ABSTRACT

Codebook indices for a scalable speech and audio codec may be efficiently encoded based on anticipated probability distributions for such codebook indices. A residual signal from a Code Excited Linear Prediction (CELP)-based encoding layer may be obtained, where the residual signal is a difference between an original audio signal and a reconstructed version of the original audio signal. The residual signal may be transformed at a Discrete Cosine Transform (DCT)-type transform layer to obtain a corresponding transform spectrum. The transform spectrum is divided into a plurality of spectral bands, where each spectral band having a plurality of spectral lines. A plurality of different codebooks are then selected for encoding the spectral bands, where each codebook is associated with a codebook index. A plurality of codebook indices associated with the selected codebooks are then encoded together to obtain a descriptor code that more compactly represents the codebook indices.

33 Claims, 15 Drawing Sheets

SPECTRUM ENCODER

(56) References Cited

U.S. PATENT DOCUMENTS

| | | | | |
|---|---|---|---|---|
| 6,662,154 | B2 * | 12/2003 | Mittal et al. | 704/219 |
| 7,110,941 | B2 * | 9/2006 | Li | 704/200.1 |
| 7,260,522 | B2 * | 8/2007 | Gao et al. | 704/219 |
| 7,272,556 | B1 * | 9/2007 | Aguilar et al. | 704/230 |
| 7,426,462 | B2 * | 9/2008 | Young et al. | 704/200.1 |
| 7,693,707 | B2 * | 4/2010 | Yamanashi et al. | 704/200.1 |
| 8,209,190 | B2 * | 6/2012 | Ashley et al. | 704/501 |
| 2003/0014136 | A1 * | 1/2003 | Wang et al. | 700/94 |
| 2003/0110027 | A1 * | 6/2003 | Mittal et al. | 704/219 |
| 2003/0191635 | A1 * | 10/2003 | Minde et al. | 704/220 |
| 2003/0220783 | A1 * | 11/2003 | Streich et al. | 704/200.1 |
| 2004/0148162 | A1 * | 7/2004 | Fingscheidt et al. | 704/224 |
| 2005/0075888 | A1 * | 4/2005 | Young et al. | 704/500 |
| 2005/0091040 | A1 * | 4/2005 | Nam et al. | 704/201 |
| 2008/0040107 | A1 * | 2/2008 | Ramprashad | 704/230 |
| 2009/0018823 | A1 * | 1/2009 | Taddei et al. | 704/201 |
| 2009/0094024 | A1 * | 4/2009 | Yamanashi et al. | 704/219 |
| 2010/0241425 | A1 * | 9/2010 | Eksler et al. | 704/220 |
| 2010/0280832 | A1 * | 11/2010 | Ojala et al. | 704/500 |
| 2010/0292993 | A1 * | 11/2010 | Vaillancourt et al. | 704/500 |
| 2011/0085671 | A1 * | 4/2011 | Gibbs | 381/23 |

FOREIGN PATENT DOCUMENTS

| | | | |
|---|---|---|---|
| JP | 6268606 | A | 9/1994 |
| JP | 10154000 | A | 6/1998 |
| JP | 2002091498 | A | 3/2002 |
| JP | 2003140693 | A | 5/2003 |
| RU | 2282888 | C2 | 8/2006 |
| RU | 2302665 | C2 | 7/2007 |
| TW | 584835 | B | 4/2004 |
| TW | I227866 | B | 2/2005 |
| TW | I271703 | B | 1/2007 |
| WO | 03027876 | A1 | 4/2003 |
| WO | 03052744 | A2 | 6/2003 |
| WO | 2006108463 | | 10/2006 |
| WO | 2007066121 | | 6/2007 |

OTHER PUBLICATIONS

Oshikiri, M.; Ehara, H.; Morii, T.; Yamanashi, T.; Satoh, K.; Yoshida, K. (Aug. 27-31, 2007). An 8-32 kbits Scalable Wideband Coder Extended with MDCT-Based Bandwidth Extension on Top of a 6.8 kbits Narrowband CELP Coder, Proceedings of the European Conference on Speech Communication and Technology (INTERSPEECH), Antwerp, Belgium.*

Ragot, S.; Kovesi, B.; Virette, D.; Trilling, R.; Massaloux, D.; , "A 8-32 KBIT/S Scalable Wideband Speech and Audio Coding Candidate for ITU-T G729EV Standardization," Acoustics, Speech and Signal Processing, 2006. ICASSP 2006 Proceedings. 2006 IEEE International Conference on , vol. 1, No., pp. I, May 14-19, 2006.*

Geiser, B.; Jax, P.; Vary, P.; Taddei, H.; Gartner, M.; Schandl, S.; , "A Qualified ITU-T G.729EV Codec Candidate for Hierarchical Speech and Audio Coding," Multimedia Signal Processing, 2006 IEEE 8th Workshop on , vol., No., pp. 114-118, Oct. 3-6, 2006.*

Minjie Xie; Adoul, J.-P.;, "Embedded algebraic vector quantizers (EAVQ) with application to wideband speech coding," Acoustics, Speech, and Signal Processing, 1996. ICASSP-96. Conference Proceedings., 1996 IEEE International Conference on, vol. 1, No., pp. 240-243 vol. 1,May 7-10, 1996.*

"Extended High-Level Description of the Q9 EV-VBR baseline Codec", VoiceAge Nokia, ITU-T SG16 Tech. Cont. COM16-C199R1-E, Jun. 2007, pp. 1-13.*

Oshikiri, M.; Ehara, H.; Morii, T.; Yamanashi, T.; Satoh, K.; Yoshida, K. (Aug. 27-31, 2007). An 8-32 kbits Scalable Wideband Coder Extended with MDCT-Based Bandwidth Extension on Top of a 6.8 kbit/s Narrowband CELP Coder, Proceedings of the European Conference on Speech Communication and Technology (INTERSPEECH), Antwerp, Belgium.*

Ragot, S.; Kovesi, B.; Virette, D.; Trilling, R.; Massaloux, D.;, "A 8-32 KBIT/S Scalable Wideband Speech and Audio Coding Candidate for ITU-T G729EV Standardization," Acoustics, Speech and Signal Processing, 2006. ICASSP 2006 Proceedings. 2006 IEEE International Conference on, vol. 1, No., pp. I, May 14-16, 2006.*

Geiser, B.; Jax, P.; Vary, P.; Taddei, H.; Gartner, M.; Schandl, S.;, "A Qualified ITU-T G.729EV Codec Candidate for Hierarchical Speech and Audio Coding," Multimedia Signal Processing, 2006 IEEE 8th Workshop on, vol., No., pp. 114-118, Oct. 3-6, 2006.*

International Telecommunications Union, "Draft new Recommendation G.729EV 'An 8-32 kbit/s scalable wideband speech and audio coder bitstream interoperable with G.729' (for Consent)" ITU-T Draft Study Period 2005-2008, Study Group 16, TD 152 (WP 3/16), 3 A.

Ramprashad S.A., "A two stage hybrid embedded speech/audio coding structure," Acoustics, Speech and Signal Processing, 1998. Proceedings of the 1998 IEEE International Conference on Seattle, WA, vol. 1, May 12, 1998, pp. 337-340.

International Search Report—PCT/US08/082376, International Search Authority—European Patent Office, Feb. 6, 2009.

Written Opinion—PCT/US08/082376, International Search Authority—European Patent Office, Feb. 6, 2009.

Bessette B., et al., "The Adaptive Multirate Wideband Speech Codec (AMR-WB)", IEEE Tr. on Speech and Audio Processing, Nov. 2002, vol. 10, No. 8, pp. 620-636.

"Extended high-level description of the Q9 EV-VBR baseline codec", ITU Study Group 16, Question 9/16, Contribution 199, Jun. 2005.

Ragot S., et al., "Low-Complexity Multi-Rate Lattice Vector Quantization with Application to Wideband TCX Speech Coding at 32 Kbit/S", in Proc. ICASSP, 2004.

Taiwan Search Report—TW097142529—TIPO—Dec. 23, 2012.

* cited by examiner

TRANSMITTER DEVICE

RECEIVER DEVICE

SCALABLE AUDIO ENCODER

ENCODER FOR SCALABLE AUDIO CODEC

GENERATING SPECTRAL BANDS FROM MDCT SPECTRUM AUDIO FRAME

METHOD OF ENCODING MDCT SPECTRUM BASED ON PROBABILITY DISTRIBUTIONS

SPECTRUM ENCODER

METHOD OF GENERATING MAPPING OF CODEBOOKS TO DESCRIPTORS BASED ON PROBABILITY DISTRIBUTIONS

METHOD OF GENERATING MAPPING OF CODEBOOKS-TO-DESCRIPTORS BASED ON PROBABILITY DISTRIBUTIONS

MAPPING CODEBOOKS TO DESCRIPTORS BASED ON PROBABILITY DISTRIBUTIONS

METHOD OF GENERATING MAPPING OF DESCRIPTOR PAIRS TO PAIR-WISE DESCRIPTOR CODES

SCALABLE AUDIO DECODER

SPECTRUM DECODER

METHOD OF DECODING MDCT SPECTRUM BASED ON PROBABILITY DISTRIBUTIONS

TECHNIQUE FOR ENCODING/DECODING OF CODEBOOK INDICES FOR QUANTIZED MDCT SPECTRUM IN SCALABLE SPEECH AND AUDIO CODECS

CLAIM OF PRIORITY UNDER 35 U.S.C. §119

The present Application for Patent claims priority to U.S. Provisional Application No. 60/985,263 entitled "Low-Complexity Technique for Encoding/Decoding of Quantized MDCT Spectrum in Scalable Speech+Audio Codecs" filed Nov. 4, 2007, and assigned to the assignee hereof and hereby expressly incorporated by reference herein.

BACKGROUND

1. Field

The following description generally relates to encoders and decoders and, in particular, to an efficient way of coding modified discrete cosine transform (MDCT) spectrum as part of a scalable speech and audio codec.

2. Background

One goal of audio coding is to compress an audio signal into a desired limited information quantity while keeping as much as the original sound quality as possible. In an encoding process, an audio signal in a time domain is transformed into a frequency domain.

Perceptual audio coding techniques, such as MPEG Layer-3 (MP3), MPEG-2 and MPEG-4, make use of the signal masking properties of the human ear in order to reduce the amount of data. By doing so, the quantization noise is distributed to frequency bands in such a way that it is masked by the dominant total signal, i.e. it remains inaudible. Considerable storage size reduction is possible with little or no perceptible loss of audio quality.

Perceptual audio coding techniques are often scalable and produce a layered bit stream having a base or core layer and at least one enhancement layer. This allows bit-rate scalability, i.e. decoding at different audio quality levels at the decoder side or reducing the bit rate in the network by traffic shaping or conditioning.

Code excited linear prediction (CELP) is a class of algorithms, including algebraic CELP (ACELP), relaxed CELP (RCELP), low-delay (LD-CELP) and vector sum excited linear predication (VSELP), that is widely used for speech coding. One principle behind CELP is called Analysis-by-Synthesis (AbS) and means that the encoding (analysis) is performed by perceptually optimizing the decoded (synthesis) signal in a closed loop. In theory, the best CELP stream would be produced by trying all possible bit combinations and selecting the one that produces the best-sounding decoded signal. This is obviously not possible in practice for two reasons: it would be very complicated to implement and the "best sounding" selection criterion implies a human listener. In order to achieve real-time encoding using limited computing resources, the CELP search is broken down into smaller, more manageable, sequential searches using a perceptual weighting function. Typically, the encoding includes (a) computing and/or quantizing (usually as line spectral pairs) linear predictive coding coefficients for an input audio signal, (b) using codebooks to search for a best match to generate a coded signal, (c) producing an error signal which is the difference between the coded signal and the real input signal, and (d) further encoding such error signal (usually in an MDCT spectrum) in one or more layers to improve the quality of a reconstructed or synthesized signal.

Many different techniques are available to implement speech and audio codecs based on CELP algorithms. In some of these techniques, an error signal is generated which is subsequently transformed (usually using a DCT, MDCT, or similar transform) and encoded to further improve the quality of the encoded signal. However, due to the processing and bandwidth limitations of many mobile devices and networks, efficient implementation of such MDCT spectrum coding is desirable to reduce the size of information being stored or transmitted.

SUMMARY

The following presents a simplified summary of one or more embodiments in order to provide a basic understanding of some embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

In one example, a scalable speech and audio encoder is provided. A residual signal from a Code Excited Linear Prediction (CELP)-based encoding layer may be obtained, where the residual signal is a difference between an original audio signal and a reconstructed version of the original audio signal. The residual signal may be transformed at a Discrete Cosine Transform (DCT)-type transform layer to obtain a corresponding transform spectrum. The DCT-type transform layer may be a Modified Discrete Cosine Transform (MDCT) layer and the transform spectrum is an MDCT spectrum. The transform spectrum may then be divided into a plurality of spectral bands, each spectral band having a plurality of spectral lines. In some implementations, a set of spectral bands may be dropped to reduce the number of spectral bands prior to encoding. A plurality of different codebooks are then selected for encoding the spectral bands, where the codebooks have associated codebook indices. Vector quantization is performed on spectral lines in each spectral band using the selected codebooks to obtain vector quantized indices.

The codebook indices are encoded and the vector quantized indices are also encoded.

In one example, encoding the codebooks indices may include encoding at least two adjacent spectral bands into a pair-wise descriptor code that is based on a probability distribution of quantized characteristics of the adjacent spectral bands. Encoding the at least two adjacent spectral bands may include: (a) scanning adjacent pairs of spectral bands to ascertain their characteristics, (b) identifying a codebook index for each of the spectral bands, and/or (c) obtaining a descriptor component and an extension code component for each codebook index.

encoding a first descriptor component and a second descriptor component in pairs to obtain the pair-wise descriptor code. The pair-wise descriptor code may map to one of a plurality of possible variable length codes (VLC) for different codebooks. The VLC codebooks may be assigned to each pair of descriptor components based on a relative position of each corresponding spectral band within an audio frame and an encoder layer number. The pair-wise descriptor codes may be based on a quantized set of typical probability distributions of descriptor values in each pair of descriptors. A single descriptor component may be utilized for codebook indices greater than a value k, and extension code components are utilized for codebook indices greater than the value k. In one example, each codebook index is associated a descriptor component that is based on a statistical analysis of distributions of possible codebook indices, with codebook indices having a greater probability of being selected being assigned individual descriptor components and codebook indices having a smaller probability of being selected being grouped and assigned to a single descriptor.

A bitstream of the encoded codebook indices and encoded vector quantized indices is then formed to represent the quantized transform spectrum.

A scalable speech and audio decoder is also provided. A bitstream is obtained having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer. The plurality of encoded codebook indices are then decoded to obtain decoded codebook indices for a plurality of spectral bands. Similarly, the plurality of encoded vector quantized indices are also decoded to obtain decoded vector quantized indices for the plurality of spectral bands. The plurality of spectral bands can then be synthesized using the decoded codebook indices and decoded vector quantized indices to obtain a reconstructed version of the residual signal at an Inverse Discrete Cosine Transform (IDCT)-type inverse transform layer. The IDCT-type transform layer may be an Inverse Modified Discrete Cosine Transform (IMDCT) layer and the transform spectrum is an IMDCT spectrum.

The plurality of encoded codebook indices may be represented by a pair-wise descriptor code representing a plurality of adjacent transform spectrum spectral bands of an audio frame. The pair-wise descriptor code may be based on a probability distribution of quantized characteristics of the adjacent spectral bands. The pair-wise descriptor code maps to one of a plurality of possible variable length codes (VLC) for different codebooks. VLC codebooks may be assigned to each pair of descriptor components is based on a relative position of each corresponding spectral band within the audio frame and an encoder layer number.

In one example, decoding the plurality of encoded codebook indices includes may include: (a) obtaining a descriptor component corresponding to each of the plurality of spectral bands, (b) obtaining an extension code component corresponding to each of the plurality of spectral bands, (c) obtaining a codebook index component corresponding to each of the plurality of spectral bands based on the descriptor component and extension code component, and/or (d) utilizing the codebook index to synthesize a spectral band for each corresponding to each of the plurality of spectral bands. The descriptor component may be associated with a codebook index that is based on a statistical analysis of distributions of possible codebook indices, with codebook indices having a greater probability of being selected being assigned individual descriptor components and codebook indices having a smaller probability of being selected being grouped and assigned to a single descriptor. A single descriptor component may be utilized for codebook indices greater than a value k, and extension code components are utilized for codebook indices greater than the value k. Pair-wise descriptor codes may be based on a quantized set of typical probability distributions of descriptor values in each pair of descriptors.

BRIEF DESCRIPTION OF THE DRAWINGS

Various features, nature, and advantages may become apparent from the detailed description set forth below when taken in conjunction with the drawings in which like reference characters identify correspondingly throughout.

DETAILED DESCRIPTION

Figure 1:
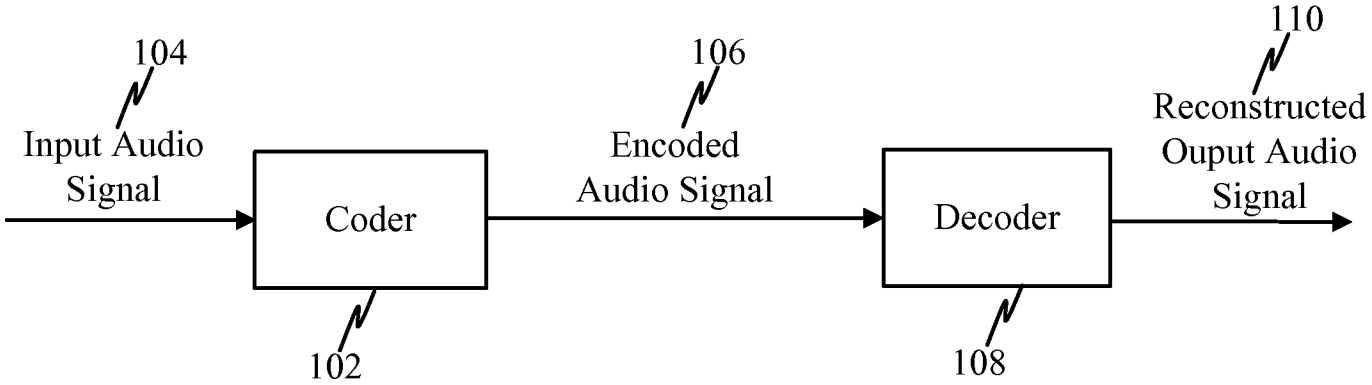
FIG. 1 is a block diagram illustrating a communication system in which one or more coding features may be implemented.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

Overview

In a scalable codec for encoding/decoding audio signals in which multiple layers of coding are used to iteratively encode an audio signal, a Modified Discrete Cosine Transform may be used in one or more coding layers where audio signal residuals are transformed (e.g., into an MDCT domain) for encoding. In the MDCT domain, a frame of spectral lines may be divided into a plurality of bands. Each spectral band may be efficiently encoded by a codebook index. A codebook index may be further encoded into a small set of descriptors with extension codes, and descriptors for adjacent spectral bands may be further encoded into pair-wise descriptor codes that recognize that some codebook indices and descriptors have a higher probability distribution than others. Additionally, the codebook indices are also encoded based on the relative position of corresponding spectral bands within a transform spectrum as well as an encoder layer number.

In one example, a set of embedded algebraic vector quantizers (EAVQ) are used for coding of n-point bands of an MDCT spectrum. The vector quantizers may be losslessly compressed into indices defining the rate and codebook numbers used to encode each n-point band. The codebook indices may be further encoded using a set of context-selectable Huffman codes that are representative of pair-wise codebook indices for adjacent spectral bands. For large values of indices, further unary coded extensions may be further used to represent descriptor values representative of the codebook indices.

Communication System

FIG. 1 is a block diagram illustrating a communication system in which one or more coding features may be implemented. A coder 102 receives an incoming input audio signal 104 and generates and encoded audio signal 106. The encoded audio signal 106 may be transmitted over a transmission channel (e.g., wireless or wired) to a decoder 108. The decoder 108 attempts to reconstructs the input audio signal 104 based on the encoded audio signal 106 to generate a reconstructed output audio signal 110. For purposes of illustration, the coder 102 may operate on a transmitter device while the decoder device may operate on receiving device. However, it should be clear that any such devices may include both an encoder and decoder.

Figure 2:
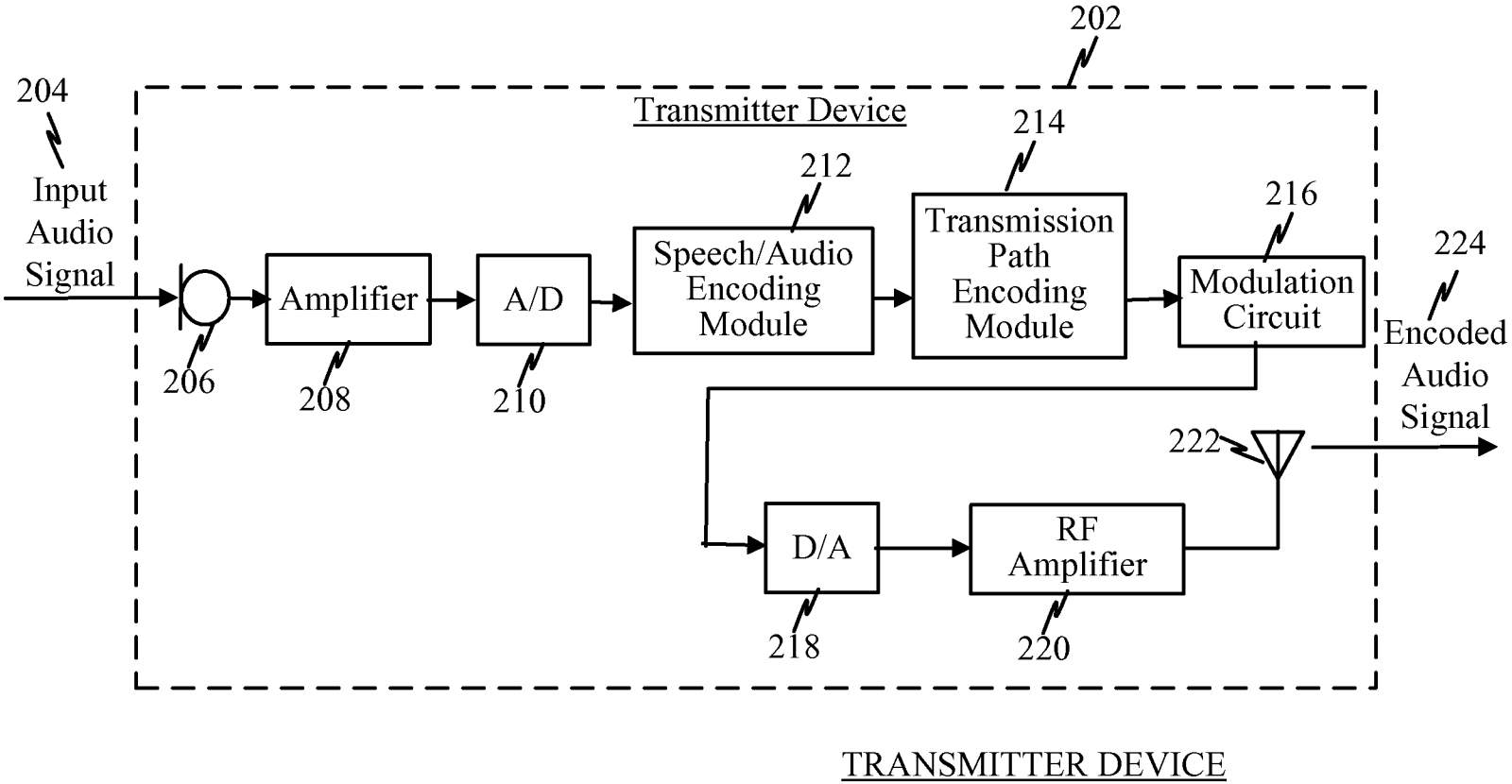
FIG. 2 is a block diagram illustrating a transmitting device that may be configured to perform efficient audio coding according to one example.

FIG. 2 is a block diagram illustrating a transmitting device 202 that may be configured to perform efficient audio coding according to one example. An input audio signal 204 is captured by a microphone 206, amplified by an amplifier 208, and converted by an A/D converter 210 into a digital signal which is sent to a speech encoding module 212. The speech encoding module 212 is configured to perform multi-layered (scaled) coding of the input signal, where at least one such layer involves encoding a residual (error signal) in an MDCT spectrum. The speech encoding module 212 may perform encoding as explained in connection with FIGS. 4, 5, 6, 7, 8, 9 and 10. Output signals from the speech encoding module 212 may be sent to a transmission path encoding module 214 where channel decoding is performed and the resulting output signals are sent to a modulation circuit 216 and modulated so as to be sent via a D/A converter 218 and an RF amplifier 220 to an antenna 222 for transmission of an encoded audio signal 224.

Figure 3:
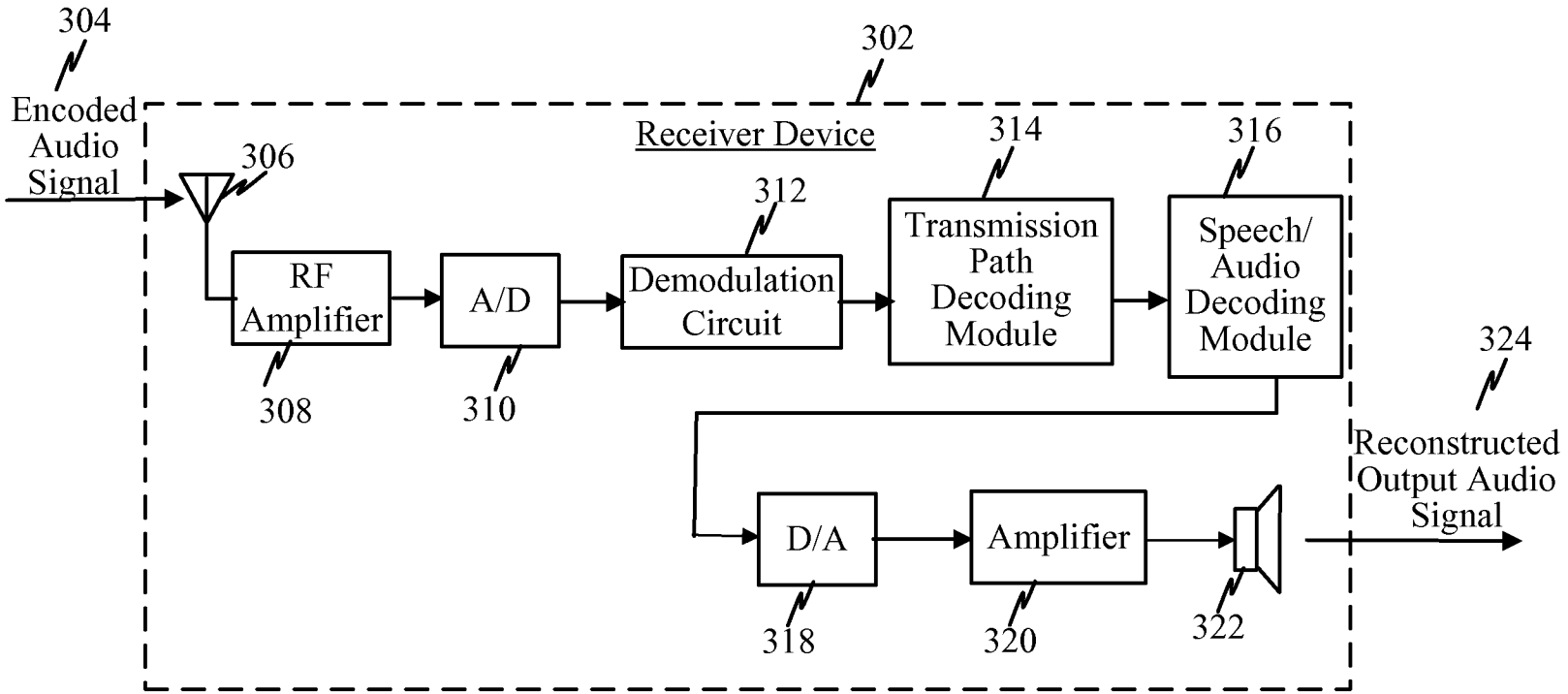
FIG. 3 is a block diagram illustrating a receiving device that may be configured to perform efficient audio decoding according to one example.

FIG. 3 is a block diagram illustrating a receiving device 302 that may be configured to perform efficient audio decoding according to one example. An encoded audio signal 304 is received by an antenna 306 and amplified by an RF amplifier 308 and sent via an A/D converter 310 to a demodulation circuit 312 so that demodulated signals are supplied to a transmission path decoding module 314. An output signal from the transmission path decoding module 314 is sent to a speech decoding module 316 configured to perform multi-layered (scaled) decoding of the input signal, where at least one such layer involves decoding a residual (error signal) in an IMDCT spectrum. The speech decoding module 316 may perform signal decoding as explained in connection with FIGS. 11, 12, and 13. Output signals from the speech decoding module 316 are sent to a D/A converter 318. An analog speech signal from the D/A converter 318 is the sent via an amplifier 320 to a speaker 322 to provide a reconstructed output audio signal 324.

Scalable Audio Codec Architecture

The coder 102 (FIG. 1), decoder 108 (FIG. 1), speech/audio encoding module 212 (FIG. 2), and/or speech/audio decoding module 316 (FIG. 3) may be implemented as a scalable audio codec. Such scalable audio codec may be implemented to provide high-performance wideband speech coding for error prone telecommunications channels, with high quality of delivered encoded narrowband speech signals or wideband audio/music signals. One approach to a scalable audio codec is to provide iterative encoding layers where the error signal (residual) from one layer is encoded in a subsequent layer to further improve the audio signal encoded in previous layers. For instance, Codebook Excited Linear Prediction (CELP) is based on the concept of linear predictive coding in which a codebook of different excitation signals is maintained on the encoder and decoder. The encoder finds the most suitable excitation signal and sends its corresponding index (from a fixed, algebraic, and/or adaptive codebook) to the decoder which then uses it to reproduce the signal (based on the codebook). The encoder performs analysis-by-synthesis by encoding and then decoding the audio signal to produce a reconstructed or synthesized audio signal. The encoder then finds the parameters that minimize the energy of the error signal, i.e., the difference between the original audio signal and a reconstructed or synthesized audio signal. The output bit-rate can be adjusted by using more or less coding layers to meet channel requirements and a desired audio quality. Such scalable audio codec may include several layers where higher layer bitstreams can be discarded without affecting the decoding of the lower layers.

Examples of existing scalable codecs that use such multi-layer architecture include the ITU-T Recommendation G.729.1 and an emerging ITU-T standard, code-named G.EV-VBR. For example, an Embedded Variable Bit Rate (EV-VBR) codec may be implemented as multiple layers L1 (core layer) through LX (where X is the number of the highest extension layer). Such codec may accept both wideband (WB) signals sampled at 16 kHz, and narrowband (NB) signals sampled at 8 kHz. Similarly, the codec output can be wideband or narrowband.

An example of the layer structure for a codec (e.g., EV-VBR codec) is shown in Table 1, comprising five layers; referred to as L1 (core layer) through L5 (the highest extension layer). The lower two layers (L1 and L2) may be based on a Code Excited Linear Prediction (CELP) algorithm. The core layer L1 may be derived from a variable multi-rate wideband (VMR-WB) speech coding algorithm and may comprise several coding modes optimized for different input signals. That is, the core layer L1 may classify the input signals to better model the audio signal. The coding error (residual) from the core layer L1 is encoded by the enhancement or extension layer L2, based on an adaptive codebook and a fixed algebraic codebook. The error signal (residual) from layer L2 may be further coded by higher layers (L3-L5) in a transform domain using a modified discrete cosine transform (MDCT). Side information may be sent in layer L3 to enhance frame erasure concealment (FEC).

TABLE 1

| Layer | Bitrate kbit/sec | Technique | Sampling rate kHz |
|---|---|---|---|
| L1 | 8 | CELP core layer (classification) | 12.8 |
| L2 | +4 | Algebraic codebook layer (enhancement) | 12.8 |

TABLE 1-continued

| Layer | Bitrate kbit/sec | Technique | | Sampling rate kHz | |
|---|---|---|---|---|---|
| L3 | +4 | FEC | MDCT | 12.8 | 16 |
| L4 | +8 | MDCT | | 16 | |
| L5 | +8 | MDCT | | 16 | |

The core layer L1 codec is essentially a CELP-based codec, and may be compatible with one of a number of well-known narrow-band or wideband vocoders such as Adaptive Multi-Rate (AMR), AMR Wideband (AMR-WB), Variable Multi-Rate Wideband (VMR-WB), Enhanced Variable Rate codec (EVRC), or EVR Wideband (EVRC-WB) codecs.

Layer 2 in a scalable codec may use codebooks to further minimize the perceptually weighted coding error (residual) from the core layer L1. To enhance the codec frame erasure concealment (FEC), side information may be computed and transmitted in a subsequent layer L3. Independently of the core layer coding mode, the side information may include signal classification.

It is assumed that for wideband output, the weighted error signal after layer L2 encoding is coded using an overlap-add transform coding based on the modified discrete cosine transform (MDCT) or similar type of transform. That is, for coded layers L3, L4, and/or L5, the signal may be encoded in the MDCT spectrum. Consequently, an efficient way of coding the signal in the MDCT spectrum is provided.

Encoder Example

Figure 4:
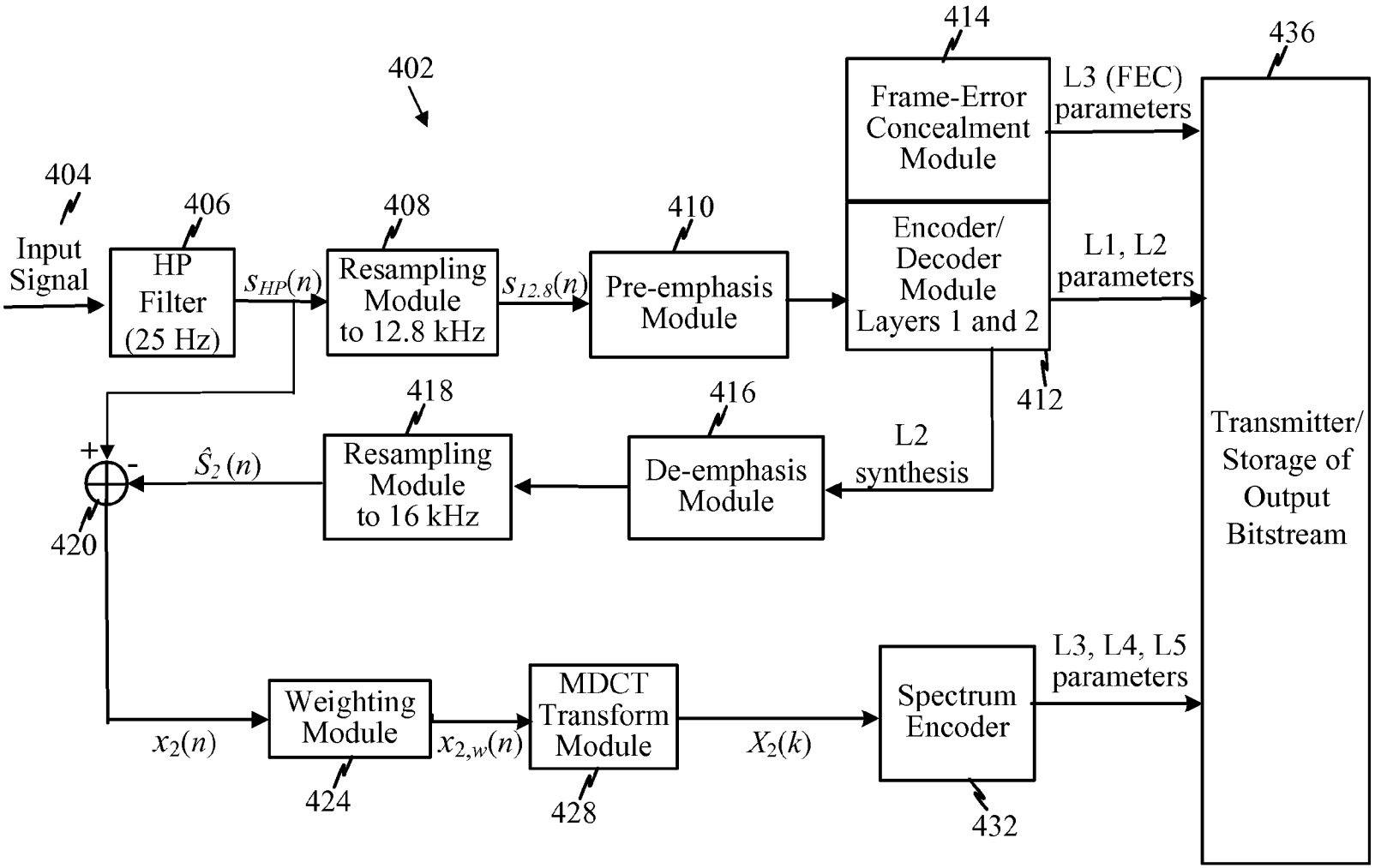
FIG. 4 is a block diagram of a scalable encoder according to one example.

FIG. 4 is a block diagram of a scalable encoder 402 according to one example. In a pre-processing stage prior to encoding, an input signal 404 is high-pass filtered 406 to suppress undesired low frequency components to produce a filtered input signal $S_{HP}(n)$. For example, the high-pass filter 406 may have a 25 Hz cutoff for a wideband input signal and 100 Hz for a narrowband input signal. The filtered input signal $S_{HP}(n)$ is then resampled by a resampling module 408 to produce a resampled input signal $S_{12.8}(n)$. For example, the original input signal 404 may be sampled at 16 kHz and is resampled to 12.8 kHz which may be an internal frequency used for layer L1 and/or L2 encoding. A pre-emphasis module 410 then applies a first-order high-pass filter to emphasize higher frequencies (and attenuate low frequencies) of the resampled input signal $S_{12.8}(n)$. The resulting signal then passes to an encoder/decoder module 412 that may perform layer L1 and/or L2 encoding based on a Code-Excited Linear Prediction (CELP)-based algorithm where the speech signal is modeled by an excitation signal passed through a linear prediction (LP) synthesis filter representing the spectral envelope. The signal energy may be computed for each perceptual critical band and used as part of layers L1 and L2 encoding. Additionally, the encoded encoder/decoder module 412 may also synthesize (reconstruct) a version of the input signal. That is, after the encoder/decoder module 412 encodes the input signal, it decodes it and a de-emphasis module 416 and a resampling module 418 recreate a version $\hat{s}_2(n)$ of the input signal 404. A residual signal $x_2(n)$ is generated by taking the difference 420 between the original signal $S_{HP}(n)$ and the recreated signal $\hat{s}_2(n)$ (i.e., $x_2(n)=S_{HP}(n)-\hat{s}_2(n)$). The residual signal $x_2(n)$ is then perceptually weighted by weighting module 424 and transformed by an MDCT transform module 428 into the MDCT spectrum or domain to generate a residual signal $x_2(k)$. In performing such transform, the signal the signal may be divided in blocks of samples, called frames, and each frame may be processed by a linear orthogonal transform, e.g. the discrete Fourier transform or the discrete cosine transform, to yield transform coefficients, which can then be quantized.

The residual signal $x_2(k)$ is then provided to a spectrum encoder 432 that encodes the residual signal $x_2(k)$ to produce encoded parameters for layers L3, L4, and/or L5. In one example, the spectrum encoder 432 generates an index representing non-zero spectral lines (pulses) in the residual signal $X_2(k)$.

The parameters from layers L1 to L5 can be sent to a transmitter and/or storage device 436 to serve as an output bitstream which can be subsequently be used to reconstruct or synthesize a version of the original input signal 404 at a decoder.

Layer 1—Classification Encoding: The core layer L1 may be implemented at the encoder/decoder module 412 and may use signal classification and four distinct coding modes to improve encoding performance. In one example, these four distinct signal classes that can be considered for different encoding of each frame may include: (1) unvoiced coding (UC) for unvoiced speech frames, (2) voiced coding (VC) optimized for quasi-periodic segments with smooth pitch evolution, (3) transition mode (TC) for frames following voiced onsets designed to minimize error propagation in case of frame erasures, and (4) generic coding (GC) for other frames. In Unvoiced coding (UC), an adaptive codebook is not used and the excitation is selected from a Gaussian codebook. Quasi-periodic segments are encoded with Voiced coding (VC) mode. Voiced coding selection is conditioned by a smooth pitch evolution. The Voiced coding mode may use ACELP technology. In Transition coding (TC) frame, the adaptive codebook in the subframe containing the glottal impulse of the first pitch period is replaced with a fixed codebook.

In the core layer L1, the signal may be modeled using a CELP-based paradigm by an excitation signal passing through a linear prediction (LP) synthesis filter representing the spectral envelope. The LP filter may be quantized in the Immitance spectral frequency (ISF) domain using a Safety-Net approach and a multi-stage vector quantization (MSVQ) for the generic and voiced coding modes. An open-loop (OL) pitch analysis is performed by a pitch-tracking algorithm to ensure a smooth pitch contour. However, in order to enhance the robustness of the pitch estimation, two concurrent pitch evolution contours may be compared and the track that yields the smoother contour is selected.

Two sets of LPC parameters are estimated and encoded per frame in most modes using a 20 ms analysis window, one for the frame-end and one for the mid-frame. Mid-frame ISFs are encoded with an interpolative split VQ with a linear interpolation coefficient being found for each ISF sub-group, so that the difference between the estimated and the interpolated quantized ISFs is minimized. In one example, to quantize the ISF representation of the LP coefficients, two codebook sets (corresponding to weak and strong prediction) may be searched in parallel to find the predictor and the codebook entry that minimize the distortion of the estimated spectral envelope. The main reason for this Safety-Net approach is to reduce the error propagation when frame erasures coincide with segments where the spectral envelope is evolving rapidly. To provide additional error robustness, the weak predictor is sometimes set to zero which results in quantization without prediction. The path without prediction may always be chosen when its quantization distortion is sufficiently close to the one with prediction, or when its quantization distortion is small enough to provide transparent coding. In addition, in strongly-predictive codebook search, a sub-optimal code vector is chosen if this does not affect the clean-channel performance but is expected to decrease the error propagation in the presence of frame-erasures. The ISFs of UC and TC frames are further systematically quantized without prediction. For UC frames, sufficient bits are available to allow for very good spectral quantization even without prediction. TC frames are considered too sensitive to frame erasures for prediction to be used, despite a potential reduction in clean channel performance.

For narrowband (B) signals, the pitch estimation is performed using the L2 excitation generated with unquantized optimal gains. This approach removes the effects of gain quantization and improves pitch-lag estimate across the layers. For wideband (WB) signals, standard pitch estimation (L1 excitation with quantized gains) is used.

Layer 2—Enhancement Encoding: In layer L2, the encoder/decoder module 412 may encode the quantization error from the core layer L1 using again the algebraic codebooks. In the L2 layer, the encoder further modifies the adaptive codebook to include not only the past L1 contribution, but also the past L2 contribution. The adaptive pitch-lag is the same in L1 and L2 to maintain time synchronization between the layers. The adaptive and algebraic codebook gains corresponding to L1 and L2 are then re-optimized to minimize the perceptually weighted coding error. The updated L1 gains and the L2 gains are predictively vector-quantized with respect to the gains already quantized in L1. The CELP layers (L1 and L2) may operate at internal (e.g. 12.8 kHz) sampling rate. The output from layer L2 thus includes a synthesized signal encoded in the 0-6.4 kHz frequency band. For wideband output, the AMR-WB bandwidth extension may be used to generate the missing 6.4-7 kHz bandwidth.

Layer 3—Frame Erasure Concealment: To enhance the performance in frame erasure conditions (FEC), a frame-error concealment module 414 may obtain side information from the encoder/decoder module 412 and uses it to generate layer L3 parameters. The side information may include class information for all coding modes. Previous frame spectral envelope information may be also transmitted for core layer Transition coding. For other core layer coding modes, phase information and the pitch-synchronous energy of the synthesized signal may also be sent.

Layers 3, 4, 5—Transform Coding: The residual signal $x_2(k)$ resulting from the second stage CELP coding in layer L2 may be quantized in layers L3, L4 and L5 using an MDCT or similar transform with overlap add structure. That is, the residual or "error" signal from a previous layer is used by a subsequent layer to generate its parameters (which seek to efficiently represent such error for transmission to a decoder).

The MDCT coefficients may be quantized by using several techniques. In some instances, the MDCT coefficients are quantized using scalable algebraic vector quantization. The MDCT may be computed every 20 milliseconds (ms), and its spectral coefficients are quantized in 8-dimensional blocks. An audio cleaner (MDCT domain noise-shaping filter) is applied, derived from the spectrum of the original signal. Global gains are transmitted in layer L3. Further, few bits are used for high frequency compensation. The remaining layer L3 bits are used for quantization of MDCT coefficients. The layer L4 and L5 bits are used such that the performance is maximized independently at layers L4 and L5 levels.

In some implementations, the MDCT coefficients may be quantized differently for speech and music dominant audio contents. The discrimination between speech and music contents is based on an assessment of the CELP model efficiency by comparing the L2 weighted synthesis MDCT components to the corresponding input signal components. For speech dominant content, scalable algebraic vector quantization (AVQ) is used in L3 and L4 with spectral coefficients quantized in 8-dimensional blocks. Global gain is transmitted in L3 and a few bits are used for high-frequency compensation. The remaining L3 and L4 bits are used for the quantization of the MDCT coefficients. The quantization method is the multi-rate lattice VQ (MRLVQ). A novel multi-level permutation-based algorithm has been used to reduce the complexity and memory cost of the indexing procedure. The rank computation is done in several steps: First, the input vector is decomposed into a sign vector and an absolute-value vector. Second, the absolute-value vector is further decomposed into several levels. The highest-level vector is the original absolute-value vector. Each lower-level vector is obtained by removing the most frequent element from the upper-level vector. The position parameter of each lower-level vector related to its upper-level vector is indexed based on a permutation and combination function. Finally, the index of all the lower-levels and the sign are composed into an output index.

For music dominant content, a band selective shape-gain vector quantization (shape-gain VQ) may be used in layer L3, and an additional pulse position vector quantizer may be applied to layer L4. In layer L3, band selection may be performed firstly by computing the energy of the MDCT coefficients. Then the MDCT coefficients in the selected band are quantized using a multi-pulse codebook. A vector quantizer is used to quantize band gains for the MDCT coefficients (spectral lines) for the band. For layer L4, the entire bandwidth may be coded using a pulse positioning technique. In the event that the speech model produces unwanted noise due to audio source model mismatch, certain frequencies of the L2 layer output may be attenuated to allow the MDCT coefficients to be coded more aggressively. This is done in a closed loop manner by minimizing the squared error between the MDCT of the input signal and that of the coded audio signal through layer L4. The amount of attenuation applied may be up to 6 dB, which may be communicated by using 2 or fewer bits. Layer L5 may use additional pulse position coding technique.

Coding of MDCT Spectrum

Because layers L3, L4, and L5 perform coding in the MDCT spectrum (e.g., MDCT coefficients representing the residual for the previous layer), it is desirable for such MDCT spectrum coding to be efficient. Consequently, an efficient method of MDCT spectrum coding is provided.

Figure 5:
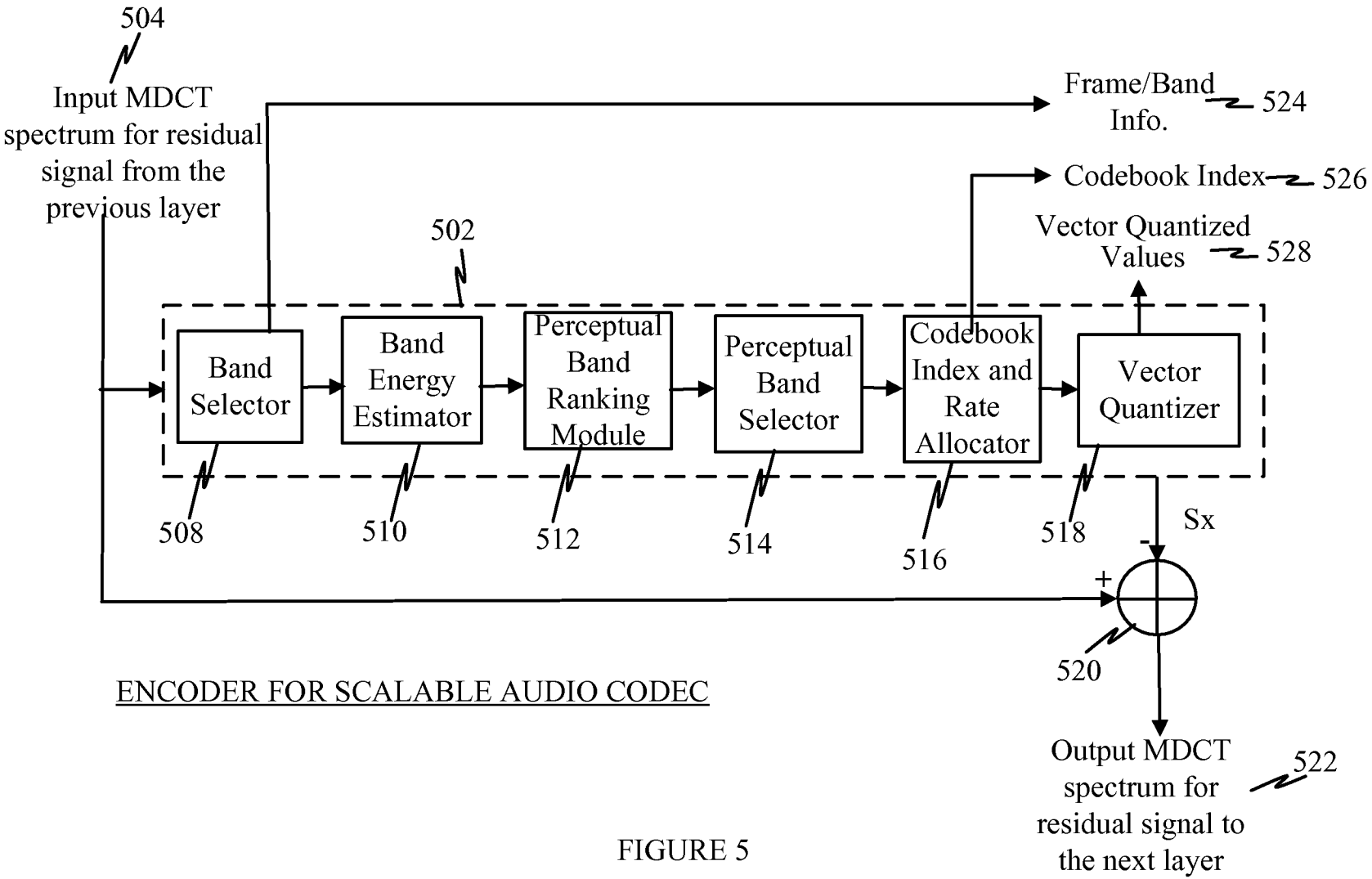
FIG. 5 is a block diagram illustrating an example MDCT spectrum encoding process that may be implemented at higher layers of an encoder.

FIG. 5 is a block diagram illustrating an example MDCT spectrum encoding process that may be implemented at higher layers of an encoder. The encoder 502 obtains the input MDCT spectrum of a residual signal 504 from the previous layers. Such residual signal 504 may be the difference between an original signal and a reconstructed version of the original signal (e.g., reconstructed from an encoded version of the original signal). The MDCT coefficients of the residual signal may be quantized to generate spectral lines for a given audio frame.

In one example, the MDCT spectrum 504 may be either a complete MDCT spectrum of an error signal after a CELP core (Layers 1 and 2) is applied, or residual MDCT spectrum after previous applications of this procedure. That is, at Layer 3, complete MDCT spectrum for a residual signal form Layers 1 and 2 is received and partially encode. Then at Layer 4, an MDCT spectrum residual of the signal from Layer 3 is encoded, and so on.

The encoder 502 may include a band selector 508 that divides or split the MDCT spectrum 504 into a plurality of bands, where each band includes a plurality of spectral lines or transform coefficients. A band energy estimator 510 may then provide an estimate of the energy in one or more of the bands. A perceptual band ranking module 512 may perceptually rank each band. A perceptual band selector 514 may then decide to encode some bands while forcing other bands to all zero values. For instance, bands exhibiting signal energy above a threshold may be encoded while bands having signal energy below such threshold may be forced to all zero. For instance, such threshold may be set according to perceptual masking and other human audio sensitivity phenomena. Without this notion it is not obvious why one would want to do that. A codebook index and rate allocator 516 may then determine a codebook index and rate allocation for the selected bands. That is, for each band, a codebook that best represents the band is ascertained and identified by an index. The "rate" for the codebook specifies the amount of compression achieved by the codebook. A vector quantizer 518 then quantizes a plurality of spectral lines (transform coefficients) for each band into a vector quantized (VQ) value (magnitude or gain) characterizing the quantized spectral lines (transform coefficients).

In vector quantization, several samples (spectral lines or transform coefficients) are blocked together into vectors, and each vector is approximated (quantized) with one entry of a codebook. The codebook entry selected to quantize an input vector (representing spectral lines or transform coefficients in a band) is typically the nearest neighbor in the codebook space according to a distance criterion. For example, one or more centroids may be used to represent a plurality of vectors of a codebook. The input vector(s) representing a band is then compared to the codebook centroid(s) to determine which codebook (and/or codebook vector) provides a minimum distance measure (e.g., Euclidean distance). The codebook having the closest distance is used to represent the band. Adding more entries in a codebook increases the bit rate and complexity but reduces the average distortion. The codebook entries are often referred to as code vectors.

Consequently, the encoder 502 may encode the MDCT spectrum 504 into one or more codebook indices (nQ) 526, vector quantized values (VQ) 528, and/or other audio frame and/or band information that can be used to reconstruct the a version of the MDCT spectrum for the residual signal 504. At a decoder, the received quantization index or indices and vector quantization values are used to reconstruct the quantized spectral lines (transform coefficients) for each band in a frame. An inverse transform is then applied to these quantized spectral lines (transform coefficients) to reconstruct a synthesized frame.

Note that an output residual signal 522 may be obtained (by subtracting 520 the residual signal $Sx_t$ from the original input residual signal 504) which can be used as the input for the next layer of encoding. Such output MDCT spectrum residual signal 522 may be obtained by, for example, reconstructing an MDCT spectrum from the codebook indices 526 and vector quantized values 528 and subtracting the reconstructed MDCT spectrum from the input MDCT spectrum 504 to obtain the output MDCT spectrum residual signal 522.

According to one feature, a vector quantization scheme is implemented that is a variant of an Embedded Algebraic Vector Quantization scheme described by M. Xie and J.-P. Adoul, Embedded Algebraic Vector Quantization (EAVQ) With Application To Wideband Audio Coding, IEEE International Conference on Acoustics, Speech, and Signal Processing (ICASSP), Atlanta, Ga., U.S.A, vol. 1, pp. 240-243, 1996 (Xie, 19, 96). In particular, the codebook index 526 may be efficiently represented by combining indices of two or more sequential spectral bands and utilizing probability distributions to more compactly represent the code indices.

Figure 6:
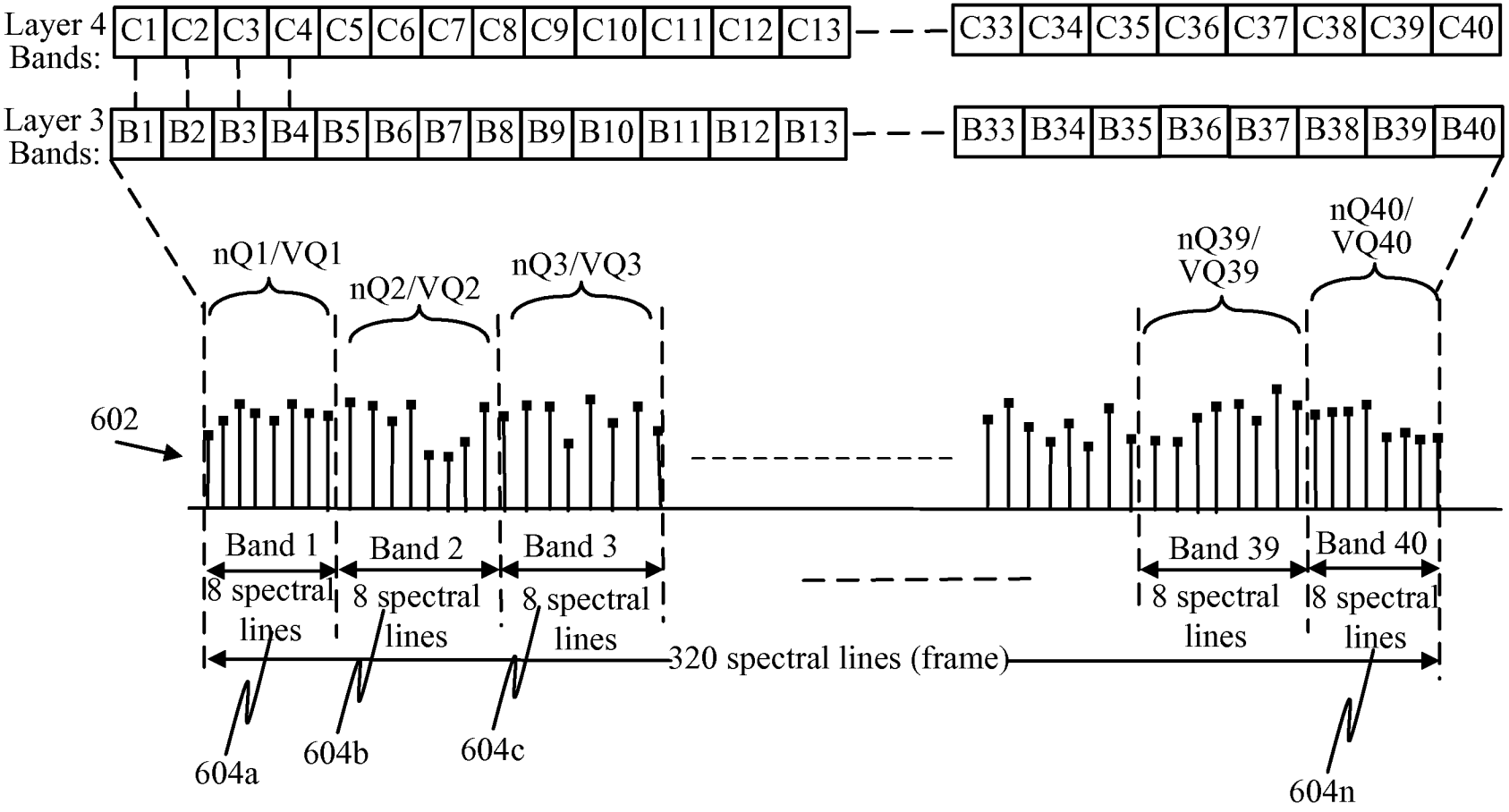
FIG. 6 is a diagram illustrating how an MDCT spectrum audio frame may be divided into a plurality of n-point bands (or sub-vectors) to facilitate encoding of an MDCT spectrum.

FIG. 6 is a diagram illustrating how an MDCT spectrum audio frame 602 may be divided into a plurality of n-point bands (or sub-vectors) to facilitate encoding of an MDCT spectrum. For example, a 320 spectral line (transform coefficient) MDCT spectrum audio frame 602 may be divided into 40 bands (sub-vectors) 604, each band 604*a* having 8 points (or spectral lines). In some practical situations (e.g. with prior knowledge that the input signal has a narrower spectrum) it might be further possible to force the last 4-5 bands to zeros, which leaves only 35-36 bands to be encoded. In some additional situations (for example in encoding of higher layers), it might be possible to skip some 10 lower-order (low-frequency) bands, thus further reducing the number of bands to be encoded to just 25-26. In a more general case, each layer may specify a particular subset of bands to be encoded, and these bands may overlap with previously encoded subsets. For example, the layer 3 bands B1-B40 may overlap with the layer 4 bands C1-C40. Each band 604 may be represented by a codebook index nQx and a vector quantized value VQx.

Vector Quantization Encoding Scheme

In one example, an encoder may utilize array of codebooks $Q_n$, for n=0, 2, 3, 4, . . . MAX, with corresponding assigned rates of n*4 bits. It is assumed that $Q_o$ contains an all-zero vector, and so no bits are needed to transmit it. Furthermore, index n=1 is not used, this is done to reduce the number of codebooks. So the minimum rate that can be assigned to a codebook with non-zero vectors is 2*4=8 bits. In order to specify which codebook is used for encoding of each band, codebook indices nQ (values n) are used along with vector quantization (VQ) values or indices for each band.

In general each codebook index may be represented by a descriptor component that is based on a statistical analysis of distributions of possible codebook indices, with codebook indices having a greater probability of being selected being assigned individual descriptor components and codebook indices having a smaller probability of being selected being grouped and assigned to a single descriptor.

As indicated earlier, the series of possible codebook indices {n} has a discontinuity between codebook index 0 and index 2, and continues to number MAX, which practically may be as large as 36. Moreover, statistical analysis of distributions of possible values n indicates that over 90% of all cases are concentrated in a small set of codebook indices n={0,2,3}. Hence, in order to encode values {n}, it might be advantageous to map them in a more compact set of descriptors, as presented in Table 1.

TABLE 1

| Codebook indices | Descriptor value |
|---|---|
| 0 | 0 |
| 2 | 1 |
| 3 | 2 |
| 4 . . . MAX | 3 |

Note that this mapping is not bijective since all values of n>=4 are mapped to a single descriptor value 3. This descriptor value 3 serves the purpose of an "escape code": it indicates that the true value of the codebook index n will need to be decoded using an extension code, transmitted after descriptor. An example of a possible extension code is a classic unary code, shown in Table 2, which can be used for transmissions of codebook indices >=4.

TABLE 2

| Extension Code | Codebook index |
|---|---|
| 0 | 4 |
| 10 | 5 |
| 110 | 6 |
| 1110 | 7 |
| . . . | |
| 1 . . . 10 run of k ones | 4 + k |
| . . . | |

Additionally, the descriptors may be encoded in pairs, where each pair-wise descriptor code may have one of three (3) possible variable length codes (VLC) that may be assigned as illustrated in Table 3.

TABLE 3

| Descriptors | Codebook 0 | Codebook 1 | Codebook 2 |
|---|---|---|---|
| (0, 0) | 0110 | 0 | 00 |
| (0, 1) | 1110 | 011 | 10 |
| (0, 2) | 01011 | 011111 | 0011 |
| (0, 3) | 011111 | 0011111111 | 001111111 |
| (1, 0) | 0001 | 01 | 001 |
| (1, 1) | 00 | 0111 | 101 |
| (1, 2) | 1001 | 01111111 | 1011 |
| (1, 3) | 11011 | 011111111111 | 00111111 |
| (2, 0) | 00111 | 01111 | 0111 |
| (2, 1) | 010 | 0111111 | 01111 |
| (2, 2) | 0101 | 1011111111 | 011111 |
| (2, 3) | 111111 | 01111111111111 | 101111111 |
| (3, 0) | 10111 | 0111111111 | 10111111 |
| (3, 1) | 1101 | 01111111111 | 011111111 |
| (3, 2) | 0011 | 0111111111111 | 0111111111 |
| (3, 3) | 01111 | 11111111111111 | 1111111111 |

These pair-wise descriptor codes may be based on a quantized set of typical probability distributions of descriptor values in each pair of descriptors, and can be constructed by using, for example, a Huffman algorithm or code.

The choice of VLC codebooks to use for each pair of descriptors can be made, in part, based on a position of each band and an encoder/decoder layer number. An example of such possible assignment is shown in Table 4, where VLC codebooks (e.g. codebooks 0, 1, or 2) are assigned to spectral bands based on the spectral band positions (e.g., 0/1, 2/3, 4/5, 6/7, . . . ) within an audio frame and the encoder/decoder layer number.

TABLE 4

| | Pair's position | | | | | | | | | | | | | | | | | |
|---|---|---|---|---|---|---|---|---|---|---|---|---|---|---|---|---|---|---|
| Layers | 0 | 2 | 4 | 6 | 8 | 10 | 12 | 14 | 16 | 18 | 20 | 22 | 24 | 26 | 28 | 30 | 32 | 34 |
| L3, L4 | 0 | 0 | 0 | 0 | 1 | 2 | 2 | 1 | 1 | 1 | 1 | 1 | 1 | 1 | 1 | 2 | 2 | 2 |
| L5 | | | | | | 2 | 2 | 2 | 2 | 2 | 2 | 2 | 1 | 1 | 1 | 2 | 2 | 2 |

The example illustrated in Table 4 recognizes that, in some instances, the distribution of codebook indices and/or descriptors pairs for codebook indices may vary depending on which spectral bands are being processed within an audio frame and also on which encoding layer (e.g., Layers 3, 4, or 5) is performing the encoding. Consequently, the VLC codebook used may depend on the relative position of the pair of descriptors (corresponding to adjacent bands) within an audio frame and the encoding layer to which the corresponding bands belong.

Figure 7:
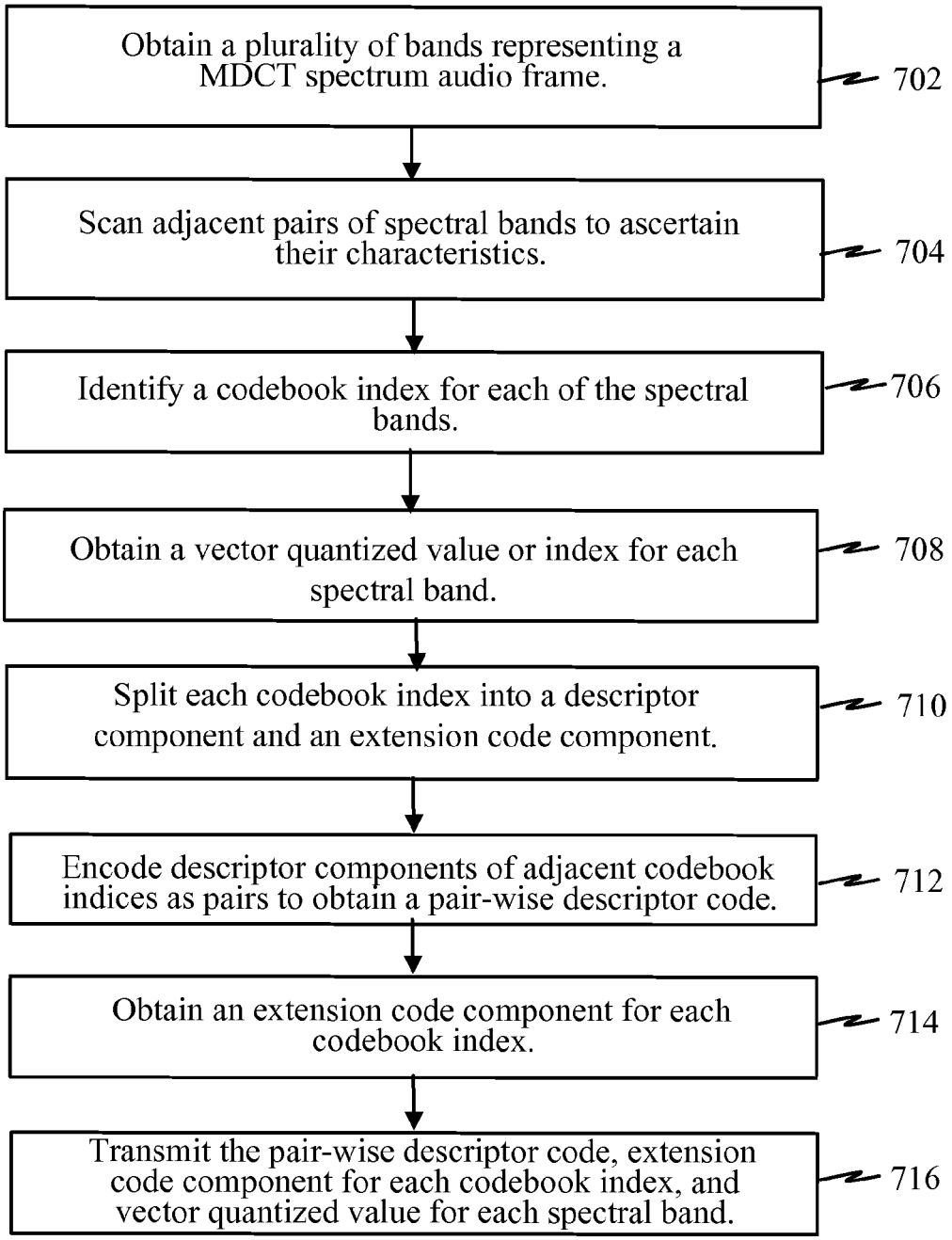
FIG. 7 is a flow diagram illustrating one example of an encoding algorithm performing encoding of MDCT embedded algebraic vector quantization (EAVQ) codebook indices.

FIG. 7 is a flow diagram illustrating one example of an encoding algorithm performing encoding of MDCT embedded algebraic vector quantization (EAVQ) codebook indices. A plurality of spectral bands representing a MDCT spectrum audio frame are obtained 702. Each spectral band may include a plurality of spectral lines or transform coefficients. Sequential or adjacent pairs of spectral bands are scanned to ascertain their characteristics 704. Based on the characteristic of each spectral band, a corresponding codebook index is identified for each of the spectral bands 706. The codebook index may identify a codebook that best represents the characteristics of such spectral band. That is, for each band, a codebook index is retrieved that is representative of the spectral lines in the band. Additionally, a vector quantized value or index is obtained for each spectral band 708. Such vector quantize value may provide, at least in part, an index into a selected entry in the codebook (e.g. reconstruction points within the codebook). In one example, each of the codebook indexes are then divided or split into a descriptor component and an extension code component 710. For instance, for a first codebook index, a first descriptor is selected from Table 1. Similarly, for a second codebook index, a second descriptor is also selected from Table 1. In general, the mapping between a codebook index and a descriptor may be based on statistical analysis of distributions of possible codebook indices, where a majority of bands in a signal tend to have indices concentrated in a small number (subset) of codebooks. The descriptors components of adjacent (e.g., sequential) codebook indices are then encoded as pairs 712, for example, based on Table 3 by pair-wise descriptor codes. These pair-wise descriptor codes may be based on a quantized set of typical probability distributions of descriptors values in each pair. The choice of VLC codebooks to use for each pair of descriptors can be made, in part, based on a position of each band and layer number, as illustrated n FIG. 4. Additionally, an extension code component is obtained for each codebook index 714, for example, based on Table 2. The pair-wise descriptor code, extension code component for each codebook index, and vector quantized value for each spectral band may then be transmitted or stored 716.

By applying the encoding scheme of codebook indices described herein, a savings of approximately 25-30% bitrate may be achieved as compared to a prior art method used, for example, in a G.729 audio compression algorithm Embedded Variable (EV)-Variable Bitrate (VBR) codec.

Example Encoder

Figure 8:
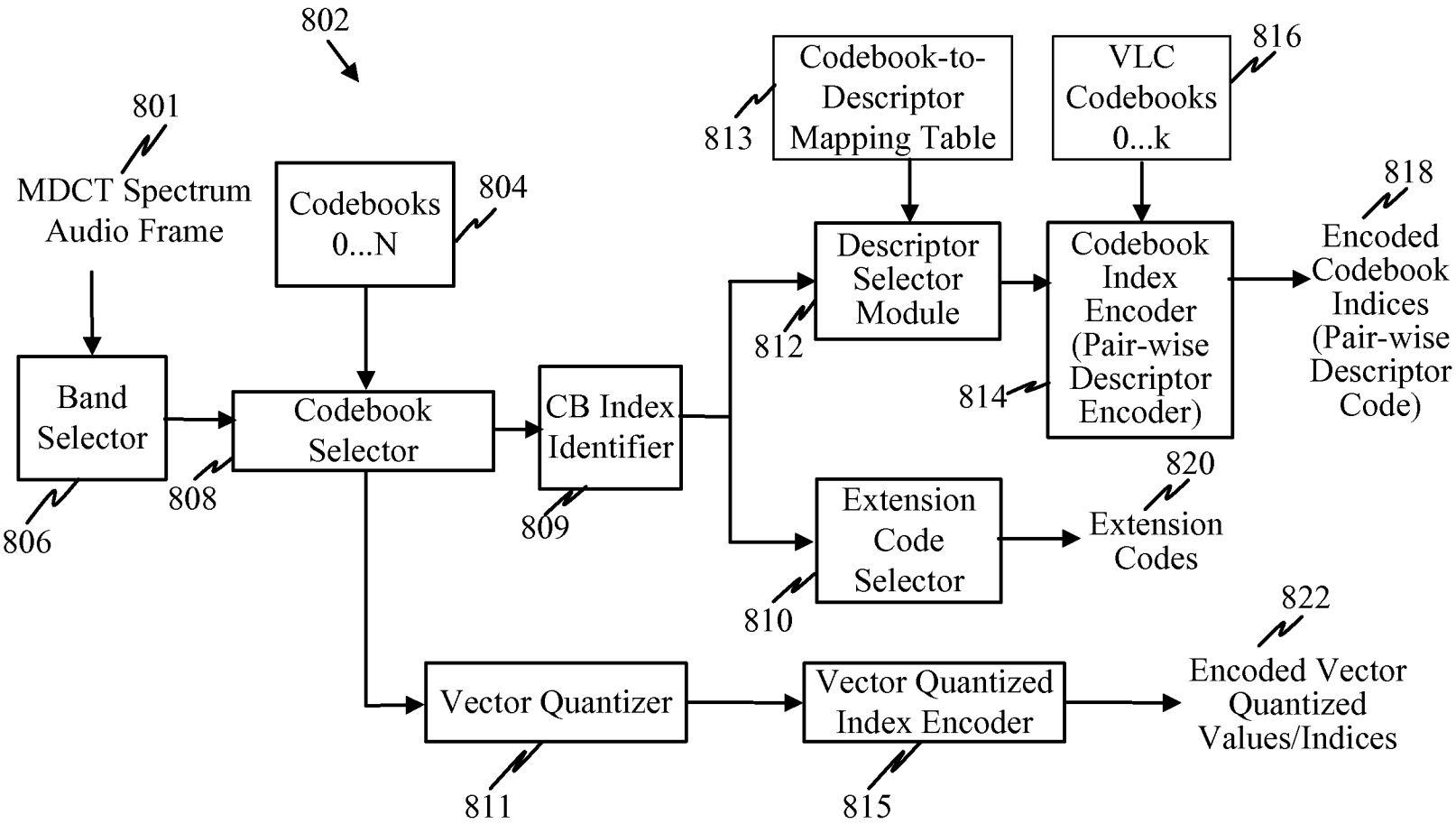
FIG. 8 is a block diagram illustrating an encoder for a scalable speech and audio codec.

FIG. 8 is a block diagram illustrating an encoder for a scalable speech and audio codec. The encoder 802 may include a band generator that receives an MDCT spectrum audio frame 801 and divides it into a plurality of bands, where each band may have a plurality of spectral lines or transform coefficients. A codebook selector 808 may then select a codebook from one of a plurality of codebooks 804 to represent each band.

Optionally, a codebook (CB) index identifier 809 may obtain a codebook index representative of the selected codebook for a particular band. A descriptor selector 812 may then use a pre-established codebook-to-descriptor mapping table 813 to represent each codebook index as a descriptor. The mapping of codebook indices to descriptors may be based on a statistical analysis of distributions of possible codebook indices, where a majority of bands in an audio frame tend to have indices concentrated in a small number (subset) of codebooks.

A codebook index encoder 814 may then encode the codebook indices for the selected codebooks to produce encoded codebook indices 818. It should be clear that such encoded codebook indices are encoded at a transform layer of a speech/audio encoding module (e.g., FIG. 2 module 212) and not at a transmission path encoding module (e.g., FIG. 2 module 214). For example, a pair of descriptors (for a pair of adjacent bands) may be encoded as a pair by a pair-wise descriptor encoder (e.g., codebook index encoder 814) that may use pre-established associations between descriptor pairs and variable length codes to obtain a pair-wise descriptor code (e.g., encoded codebook indices 818). The pre-established associations between descriptor pairs and variable length codes may utilize shorter length codes for higher probability descriptor pairs and longer codes for lower probability descriptor pairs. In some instances, it may be advantageous to map a plurality of codebooks (VLCs) to a single descriptor pair. For instance, it may be found the probability distribution of descriptor pair varies depending on the encoder/decoder layer and/or the position of the corresponding spectral bands within a frame. Consequently, such pre-established associations may be represented as a plurality of VLC codebooks 816 in which a particular codebook is selected based on the position of the pair of spectral bands being encoded/decoded (within an audio frame) and the encoding/decoding layer. A pair-wise descriptor code may represent the codebook indices for two (or more) consecutive bands in fewer bits than the combined codebook indices or the individual descriptors for the bands. Additionally, an extension code selector 810 may generate extension codes 820 to represent indices that may have been grouped together under a descriptor code. A vector quantizer 811 may generate a vector quantized value or index for each spectral band. A vector quantized index encoder 815 may then encode one or more of the vector quantized value or index to produce encoded vector quantized values/indices 822. Encoding of the vector quantized indices may be performed in such a way as to reduce the number of bits used to represent the vector quantized indices.

The encoded codebook indices 818 (e.g., pair-wise descriptor codes), extension codes 820, and/or encoded vector quantized values/indices 822 may be transmitted and/or stored as encoded representations of the MDCT spectrum audio frame 810.

Figure 9:
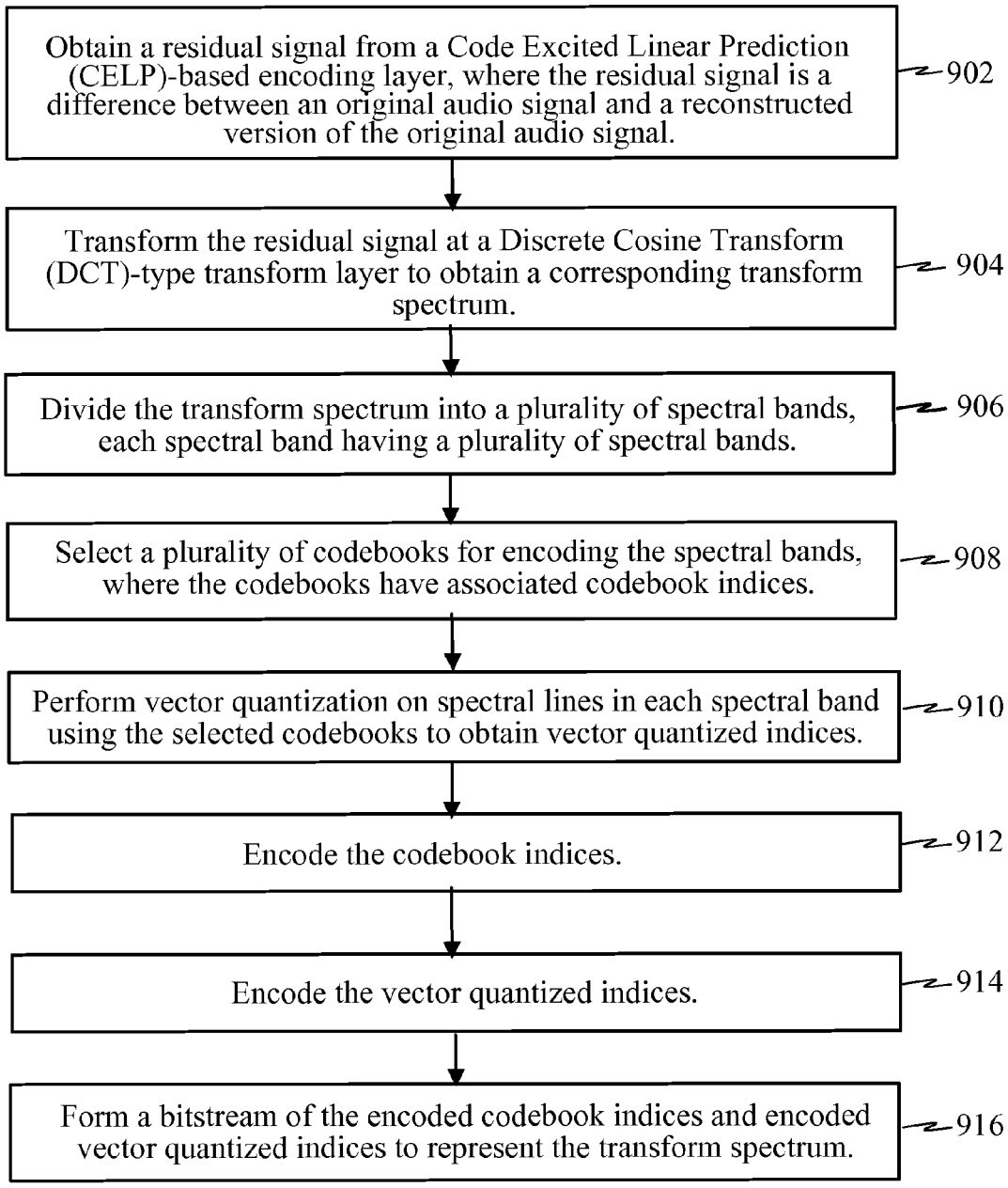
FIG. 9 is a block diagram illustrating an example of a method for obtaining a pair-wise descriptor code that encodes a plurality of spectral bands.

FIG. 9 is a block diagram illustrating a method for obtaining a pair-wise descriptor code that encodes a plurality of spectral bands. In one example, this method may operate in a scalable speech and audio codec. A residual signal is obtained from a Code Excited Linear Prediction (CELP)-based encoding layer, where the residual signal is a difference between an original audio signal and a reconstructed version of the original audio signal 902. The residual signal is transformed at a Discrete Cosine Transform (DCT)-type transform layer to obtain a corresponding transform spectrum 904. For instance, the DCT-type transform layer may be a Modified Discrete Cosine Transform (MDCT) layer and the transform spectrum is an MDCT spectrum. The transform spectrum is then divided into a plurality of spectral bands, each spectral band having a plurality of spectral lines 906. In some instances, some of the spectral bands may be removed to reduce the number of spectral bands prior to encoding. A plurality of different codebooks are selected for encoding the spectral bands, where the codebooks have associated codebook indices 908. For example, adjacent or sequential pairs of spectral bands may be scanned to ascertain their characteristics (e.g., one or more characteristics of spectral coefficients and/or lines in the spectral bands), a codebook that best represents each of the spectral bands is selected, and a codebook index may be identified and/or associated with each of the adjacent pairs of spectral bands. In some implementations, a descriptor component and/or an extension code component may be obtained and used to represent each codebook index. Vector quantization is then performed on spectral lines in each spectral band using the selected codebooks to obtain vector quantized indices 910. The selected codebook indices are then encoded 912. In one example, codebook indices or associated descriptors for adjacent spectral bands may be encoded into a pair-wise descriptor code that is based on a probability distribution of quantized characteristics of the adjacent spectral bands. Additionally, the vector quantized indices are also encoded 914. Encoding of the vector quantized indices may be performed using any algorithm that reduces the number of bits used to represent the vector quantized indices. A bitstream may be formed using the encoded codebook indices and encoded vector quantized indices to represent the transform spectrum 916.

The pair-wise descriptor code may map to one of a plurality of possible variable length codes (VLC) for different codebooks. The VLC codebooks may be assigned to each pair of descriptor components based on a position of each corresponding spectral band within the audio frame and an encoder layer number. The pair-wise descriptor codes may be based on a quantized set of typical probability distributions of descriptor values in each pair of descriptors.

In one example, each codebook index has a descriptor component that is based on a statistical analysis of distributions of possible codebook indices, with codebook indices having a greater probability of being selected being assigned individual descriptor components and codebook indices having a smaller probability of being selected being grouped and assigned to a single descriptor. A single descriptor value is utilized for codebook indices greater than a value k, and extension code components are utilized for codebook indices greater than the value k.

Example of Descriptor Generation

Figure 10:
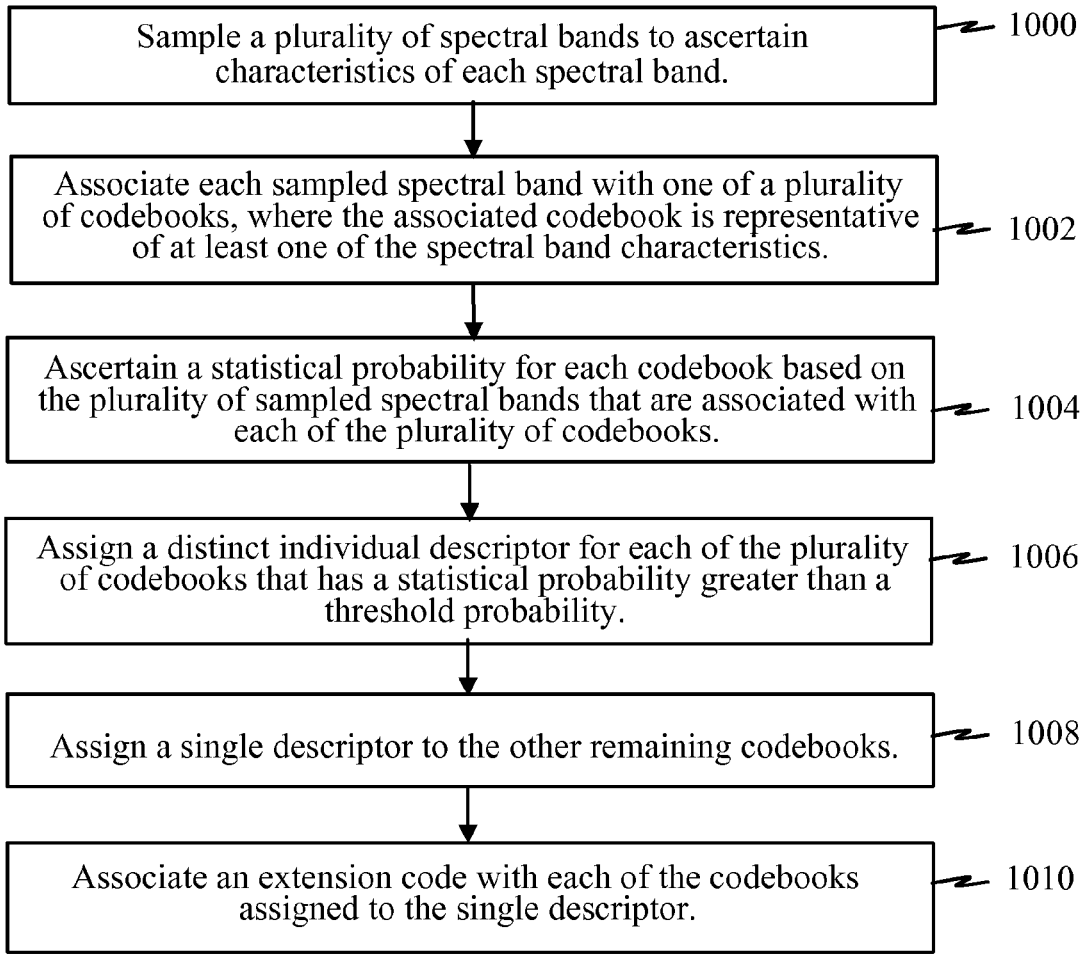
FIG. 10 is a block diagram illustrating an example of a method for generating a mapping between codebooks and descriptors based on a probability distribution.

FIG. 10 is a block diagram illustrating an example of a method for generating a mapping between codebooks and descriptors based on a probability distribution. A plurality of spectral bands are sampled to ascertain characteristics of each spectral band 1000. Recognizing that, due to the nature of sounds and codebook definitions, a small subset of the codebooks are more likely to be utilized, statistical analysis may be performed on signals of interest to assign descriptors more efficiently. Hence, each sampled spectral band is associated with one of a plurality of codebooks, where the associated codebook is representative of at least one of the spectral band characteristics 1002. A statistical probability is assigned for each codebook based on the plurality of sampled spectral bands that are associated with each of the plurality of codebooks 1004. A distinct individual descriptor is also assigned for each of the plurality of codebooks that has a statistical probability greater than a threshold probability 1006. A single descriptor is then assigned to the other remaining codebooks 1008. An extension code is associated with each of the codebooks assigned to the single descriptor 1010. Consequently, this method may be employed to obtain a sufficiently large sample of spectral bands with which to build table (e.g., Table 1) that maps codebook indices to a smaller set of descriptors. Additionally, the extension codes may be unary codes as illustrated in Table 2.

Figure 11:
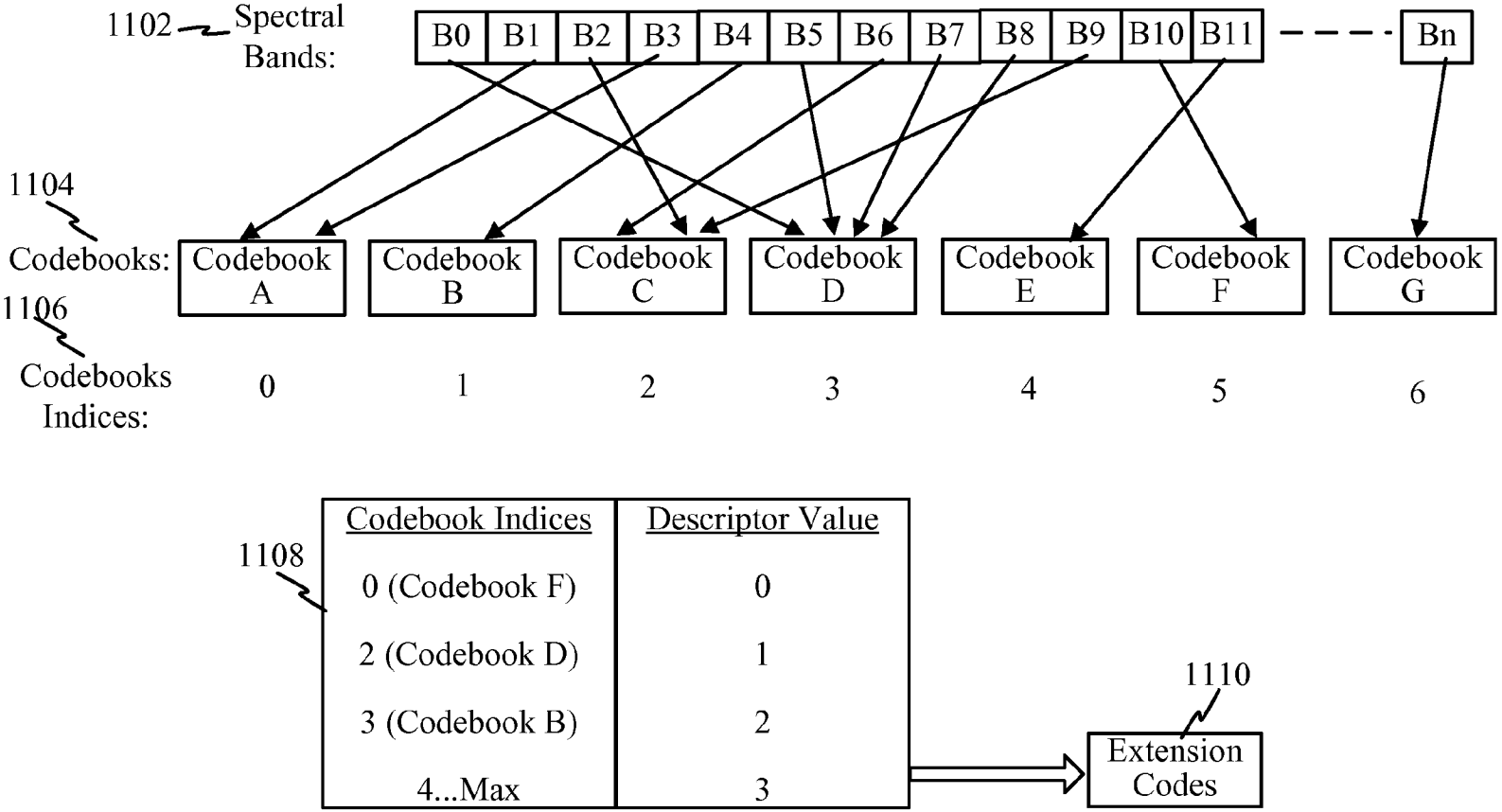
FIG. 11 is a block diagram illustrating an example of how descriptor values may be generated.

FIG. 11 is a block diagram illustrating an example of how descriptor values may be generated. For a sample sequence of spectral bands B0 . . . Bn 1102, a codebook 1104 is selected to represent each spectral band. That is, based on the characteristics of a spectral band, a codebook that most closely represents the spectral band is selected. In some implementations, each codebook may be referenced by its codebook index 1106. This process may be used to generate a statistical distribution of spectral bands to codebooks. In this example, Codebook A (e.g., the all zero codebook) is selected for two (2) spectral bands, Codebooks B is selected by one (1) spectral band, Codebook C is selected for three (3) spectral bands, and so on. Consequently, the most frequently selected codebooks may be identified and distinct/individual descriptor values "0", "1", and "2" are assigned to these frequently selected codebooks. The remaining codebooks are assigned a single descriptor value "3". For bands represented by this single descriptor "3", an extension code 1110 may be used to more specifically identify the particular codebook identified by the single descriptor (e.g., as in Table 2). In this example, Codebook B (index 1) is ignored so as to reduce the number of descriptors values to four. The four descriptors "0", "2", "3", and "4" can be mapped and represented to two bits (e.g., Table 1). Because a large percentage of the codebooks are now represented by a single two-bit descriptor value "3", this gathering of statistical distribution helps reduce the number of bits that would otherwise be used to represent, say, 36 codebooks (i.e., six bits).

Note that FIGS. 10 and 11 illustrate an example of how codebook indices may be encoded into fewer bits. In various other implementations, the concept of "descriptors" may be avoided and/or modified while achieving the same result.

Example of Pair-Wise Descriptor Code Generation

Figure 12:
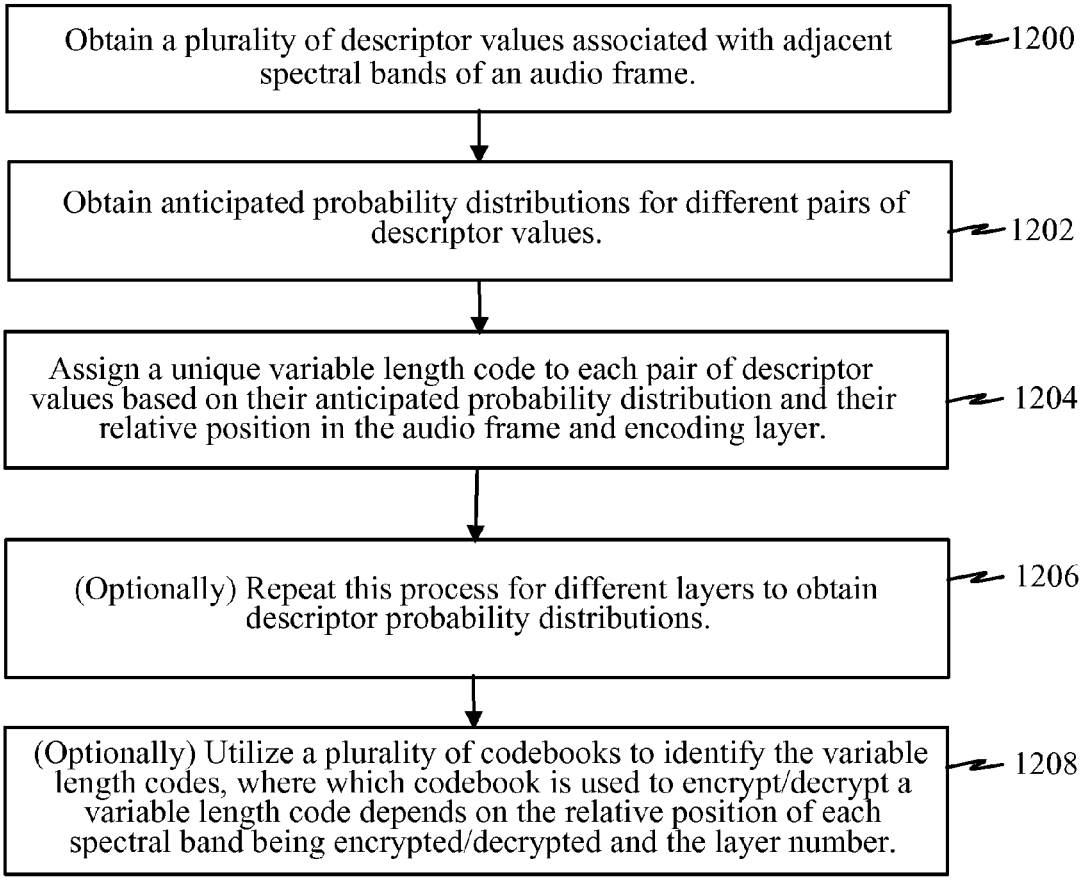
FIG. 12 is a block diagram illustrating an example of a method for obtaining generating a mapping of descriptor pairs to a pair-wise descriptor codes based a probability distribution of a plurality of descriptors for spectral bands.

FIG. 12 is a block diagram illustrating an example of a method for generating a mapping of descriptor pairs to pair-wise descriptor codes based a probability distribution of a plurality of descriptors for spectral bands. After mapping a plurality of spectral bands to descriptor values (as in previously described), a probability distribution is determined for pairs of descriptor values (e.g., for sequential or adjacent spectral bands of an audio frame). A plurality of descriptor values (e.g., two) associated with adjacent spectral bands (e.g., two consecutive bands) is obtained 1200. An anticipated probability distribution is obtained for different pairs of descriptor values 1202. That is, based on the likelihood of each pair of descriptor values (e.g., 0/0, 0/1, 0/2, 0/3, 1/0, 1/1, 1/2, 1/3, 2/0, 2/1 . . . 3/3) occurring, a distribution of most likely descriptor pairs to least likely descriptor pairs (e.g., for two adjacent or sequential spectral bands) can be ascertained. Additionally, the anticipated probability distribution may be collected based on the relative position of a particular band within the audio frame and a particular encoding layer (e.g., L3, L4, L5, etc.). A distinct variable length code (VLC) is then assigned to each pair of descriptor values based on their anticipated probability distribution and their relative position in the audio frame and encoder layer 1204. For instance, higher probability descriptor pairs (for a particular encoder layer and relative position within a frame) may be assigned shorter codes than lower probability descriptor pairs. In one example, Huffman coding may be used to generate the variable length codes, with higher probability descriptor pairs being assigned shorter codes and lower probability descriptor pairs being assigned longer codes (e.g., as in Table 3).

This process may be repeated to obtain descriptor probability distributions for different layers 1206. Consequently, different variable length codes may be utilized for the same descriptor pair in different encoder/decoder layers. A plurality of codebooks may be utilized to identify the variable length codes, where which codebook is used to encrypt/decrypt a variable length code depends on the relative position of each spectral band being encoded/decoded and the encoder layer number 1208. In the example illustrated in Table 4, different VLC codebooks may be used depending on the layer and position of the pair of bands being encoded/decoded.

This method allows building probability distributions for descriptor pairs across different encoder/decoder layers, thereby allowing mapping of the descriptor pairs to a variable length code for each layer. Because the most common (higher probability) descriptor pairs are assigned shorter codes, this reduces the number of bits used when encoding spectral bands.

Decoding of MDCT Spectrum

Figure 13:
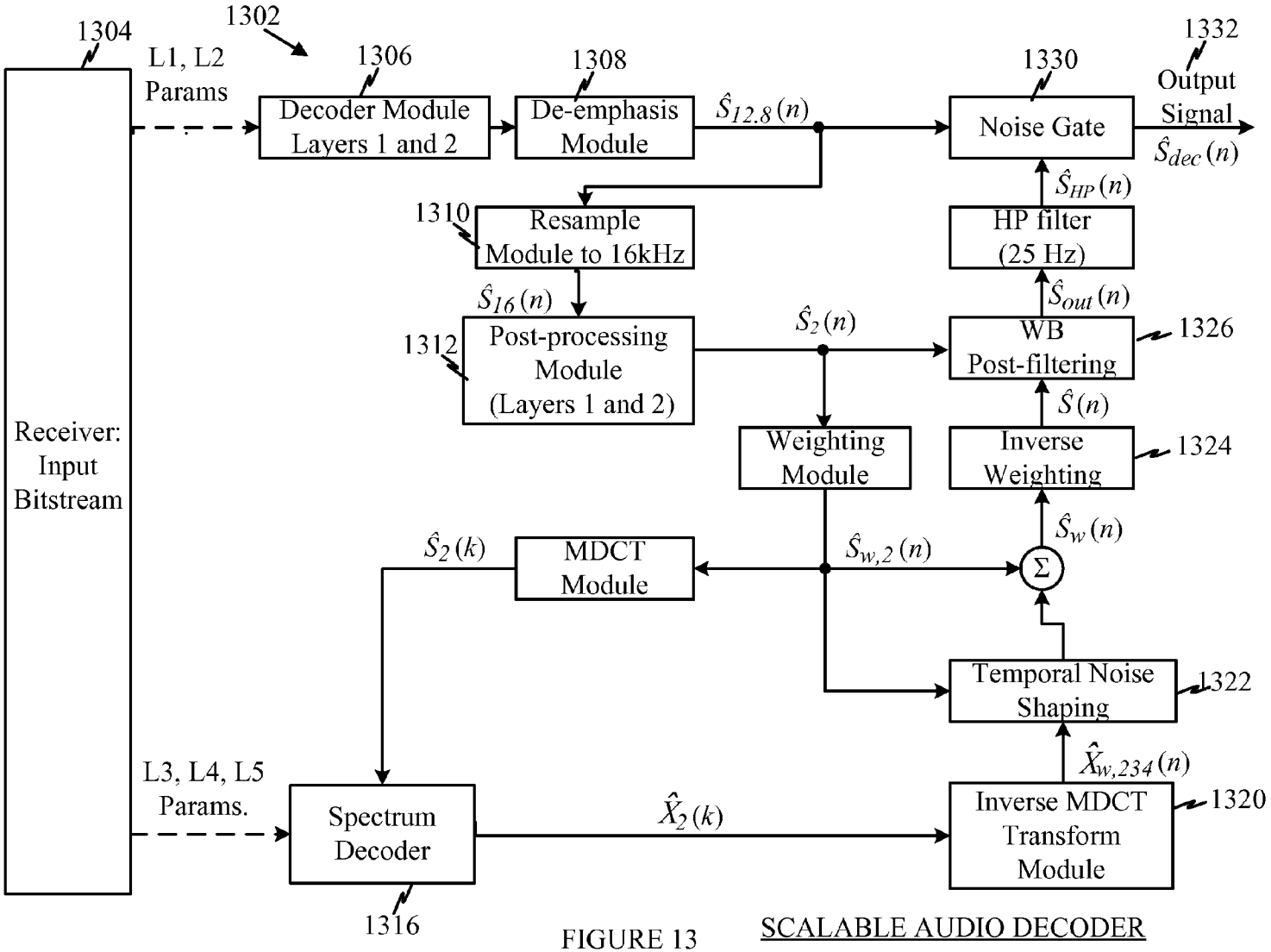
FIG. 13 is a block diagram illustrating an example of a decoder.

FIG. 13 is a block diagram illustrating an example of a decoder. For each audio frame (e.g., 20 millisecond frame), the decoder 1302 may receive an input bitstream from a receiver or storage device 1304 containing information of one or more layers of an encoded MDCT spectrum. The received layers may range from Layer 1 up to Layer 5, which may correspond to bit rates of 8 kbit/sec. to 32 kbit/sec. This means that the decoder operation is conditioned by the number of bits (layers), received in each frame. In this example, it is assumed that the output signal 1332 is WB and that all layers have been correctly received at the decoder 1302. The core layer (Layer 1) and the ACELP enhancement layer (Layer 2) are first decoded by a decoder module 1306 and signal synthesis is performed. The synthesized signal is then de-emphasized by a de-emphasis module 1308 and resampled to 16 kHz by a resampling module 1310 to generate a signal $\hat{s}_{16}(n)$. A post-processing module further processes the signal $\hat{s}_{16}(n)$ to generate a synthesized signal $\hat{s}_2(n)$ of the Layer 1 or Layer 2.

Higher layers (Layers 3, 4, 5) are then decoded by a spectrum decoder module 1316 to obtain an MDCT spectrum signal $\hat{X}_{234}(k)$. The MDCT spectrum signal $\hat{X}_{234}(k)$ is inverse transformed by inverse MDCT module 1320 and the resulting signal $\hat{X}_{w,234}(n)$ is added to the perceptually weighted synthesized signal $\hat{s}_{w,2}(n)$ of Layers 1 and 2. Temporal noise shaping is then applied by a shaping module 1322. A weighted synthesized signal $\hat{s}_{w,2}(n)$ of the previous frame overlapping with the current frame is then added to the synthesis. Inverse perceptual weighting 1324 is then applied to restore the synthesized WB signal. Finally, a pitch post-filter 1326 is applied on the restored signal followed by a high-pass filter 1328. The post-filter 1326 exploits the extra decoder delay introduced by the overlap-add synthesis of the MDCT (Layers 3, 4, 5). It combines, in an optimal way, two pitch post-filter signals. One is a high-quality pitch post-filter signal $\hat{s}_2(n)$ of the Layer 1 or Layer 2 decoder output that is generated by exploiting the extra decoder delay. The other is a low-delay pitch post-filter signal $\hat{s}(n)$ of the higher-layers (Layers 3, 4, 5) synthesis signal. The filtered synthesized signal $\hat{s}_{HP}(n)$ is then output by a noise gate 1330.

Figure 14:
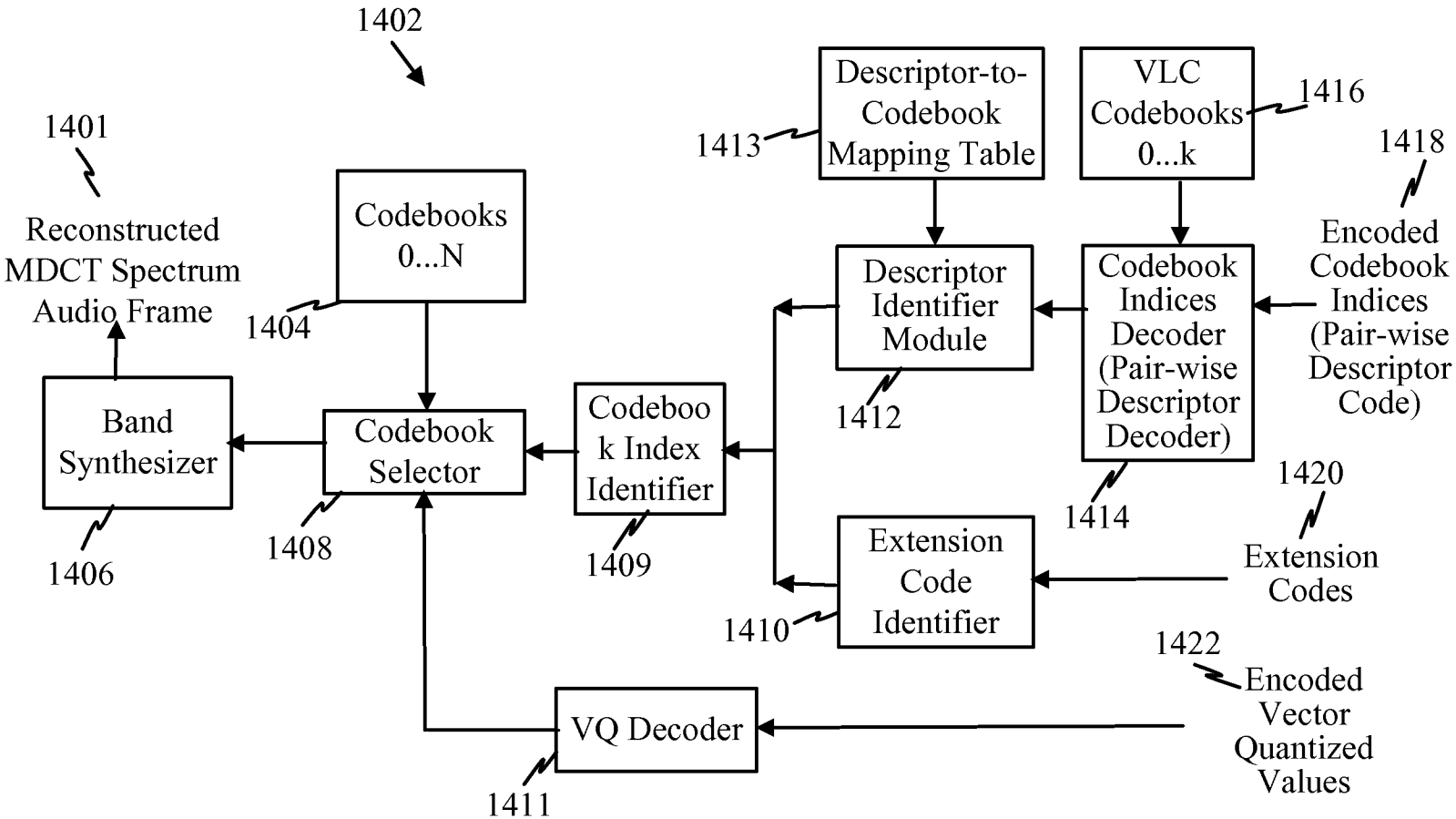
FIG. 14 is a block diagram illustrating a decoder that may efficiently decode a pair-wise descriptor code.

FIG. 14 is a block diagram illustrating a decoder that may efficiently decode a pair-wise descriptor code. The decoder 1402 may receive encoded codebook indices 1418. For example, the encoded codebook indices 1418 may be pair-wise descriptor codes and extension codes 1420. The pair-wise descriptor code may represent codebook indices for two (or more) consecutive bands in fewer bits than the combined codebook indices or the individual descriptors for the bands. A codebook indices decoder 1414 may then decode the encoded codebook indices 1418. For instance, the codebook indices decoder 1414 may decode the pair-wise descriptor codes by using pre-established associations represented by a plurality of VLC codebooks 1416 in which a VLC codebook 1416 may be selected based on the position of the pair of spectral bands being decoded (within an audio frame) and the decoding layer. The pre-established associations between descriptor pairs and variable length codes may utilize shorter length codes for higher probability descriptor pairs and longer codes for lower probability descriptor pairs. In one example, the codebook indices decoder 1414 may produce a pair of descriptors representative of the two adjacent spectral bands. The descriptors (for a pair of adjacent bands) are then decoded by a descriptor identifier 1412 that uses a descriptor-to-codebook indices mapping table 1413, generated based on a statistical analysis of distributions of possible codebook indices, where a majority of bands in an audio frame tend to have indices concentrated in a small number (subset) of codebooks. Consequently, the description identifier 1412 may provide codebook indices representative of a corresponding spectral band. A codebook index identifier 1409 then identifies the codebook indices for each band. Additionally, an extension code identifier 1410 may use the received extension code 1420 to further identify codebook indices that may have been grouped into a single descriptor. A vector quantization decoder 1411 may decode received encoded vector quantized values/indices 1422 for each spectral band. A codebook selector 1408 may then select a codebook based on the identified codebook index and extension code 1420 in order to reconstruct each spectral band using the vector quantized values 1422. A band synthesizer 1406 then reconstructs an MDCT spectrum audio frame 1401 based on the reconstructed spectral bands, where each band may have a plurality of spectral lines or transform coefficients.

Example Decoding Method

Figure 15:
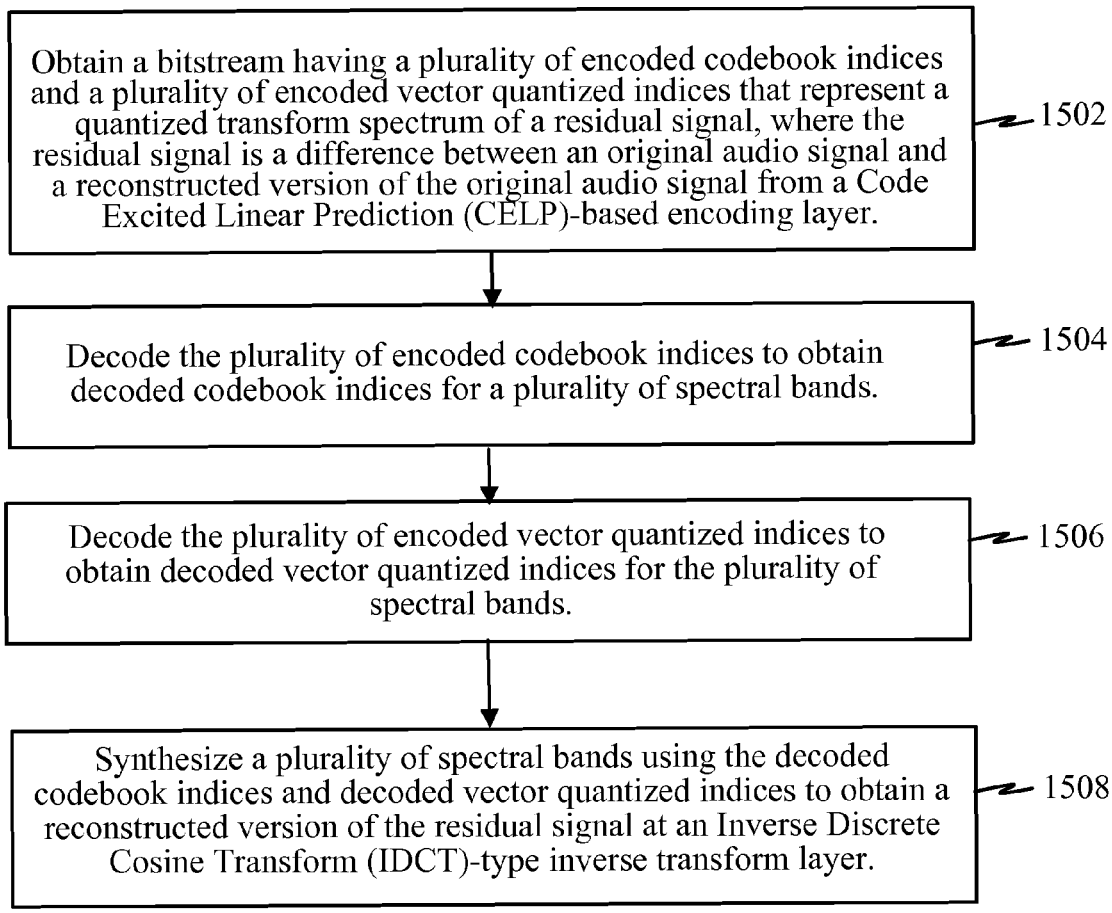
FIG. 15 is a block diagram illustrating a method for decoding a transform spectrum in a scalable speech and audio codec.

FIG. 15 is a block diagram illustrating a method for decoding a transform spectrum in a scalable speech and audio codec. A bitstream may be received or obtained having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer 1502. The IDCT-type transform layer may be an Inverse Modified Discrete Cosine Transform (IMDCT) layer and the transform spectrum is an IMDCT spectrum. The plurality of encoded codebook indices may then be decoded to obtain decoded codebook indices for a plurality of spectral bands 1504. Similarly, the plurality of encoded vector quantized indices may be decoded to obtain decoded vector quantized indices for the plurality of spectral bands 1506.

In one example, decoding the plurality of encoded codebook indices may include: (a) obtaining a descriptor component corresponding to each of the plurality of spectral bands, (b) obtaining an extension code component corresponding to each of the plurality of spectral bands, (c) obtaining a codebook index component corresponding to each of the plurality of spectral bands based on the descriptor component and extension code component; (d) utilizing the codebook index to synthesize a spectral band for each corresponding to each of the plurality of spectral bands. A descriptor component may be associated with a codebook index that is based on a statistical analysis of distributions of possible codebook indices, with codebook indices having a greater probability of being selected being assigned individual descriptor components and codebook indices having a smaller probability of being selected being grouped and assigned to a single descriptor. A single descriptor component is utilized for codebook indices greater than a value k, and extension code components are utilized for codebook indices greater than the value k. The plurality of encoded codebook indices may be represented by a pair-wise descriptor code representing a plurality of adjacent transform spectrum spectral bands of an audio frame. The pair-wise descriptor code may be based on a probability distribution of quantized characteristics of the adjacent spectral bands. In one example, the pair-wise descriptor code may map to one of a plurality of possible variable length codes (VLC) for different codebooks. The VLC codebooks may be assigned to each pair of descriptor components based on a position of each corresponding spectral band within the audio frame and an encoder layer number. The pair-wise descriptor codes may be based on a quantized set of typical probability distributions of descriptor values in each pair of descriptors.

The plurality of spectral bands may then be synthesized using the decoded codebook indices and decoded vector quantized indices to obtain a reconstructed version of the residual signal at an Inverse Discrete Cosine Transform (IDCT)-type inverse transform layer 1508.

The various illustrative logical blocks, modules and circuits and algorithm steps described herein may be implemented or performed as electronic hardware, software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. It is noted that the configurations may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

When implemented in hardware, various examples may employ a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

When implemented in software, various examples may employ firmware, middleware or microcode. The program code or code segments to perform the necessary tasks may be stored in a computer-readable medium such as a storage medium or other storage(s). A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

As used in this application, the terms "component," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

In one or more examples herein, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. Software may comprise a single instruction, or many instructions, and may be distributed over several different code segments, among different programs and across multiple storage media. An exemplary storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is required for proper operation of the embodiment that is being described, the order and/or use of specific steps and/or actions may be modified without departing from the scope of the claims.

One or more of the components, steps, and/or functions illustrated in FIGS. 1, 2, 3, 4, 5, 6, 7, 8, 9, 10, 11, 12, 13, 14 and/or 15 may be rearranged and/or combined into a single component, step, or function or embodied in several components, steps, or functions. Additional elements, components, steps, and/or functions may also be added. The apparatus, devices, and/or components illustrated in FIGS. 1, 2, 3, 4, 5, 8, 13, and 14 may be configured or adapted to perform one or more of the methods, features, or steps described in FIGS. 6-7, 9-12 and 15. The algorithms described herein may be efficiently implemented in software and/or embedded hardware.

It should be noted that the foregoing configurations are merely examples and are not to be construed as limiting the claims. The description of the configurations is intended to be illustrative, and not to limit the scope of the claims. As such, the present teachings can be readily applied to other types of apparatuses and many alternatives, modifications, and variations will be apparent to those skilled in the art.

What is claimed is:

1. A method for encoding in a scalable speech and audio codec, comprising:

obtaining a residual signal from a Code Excited Linear Prediction (CELP)-based encoding layer, where the residual signal is a difference between an original audio signal and a reconstructed version of the original audio signal;

transforming the residual signal at a Discrete Cosine Transform (DCT)-type transform layer to obtain a corresponding transform spectrum;

dividing the transform spectrum into a plurality of spectral bands, each spectral band having a plurality of spectral lines;

selecting a plurality of different codebooks for encoding the spectral bands, where the codebooks have associated codebook indices;

performing vector quantization on spectral lines in each spectral band using the selected codebooks to obtain vector quantized indices;

encoding the codebook indices, wherein encoding the codebooks indices includes encoding at least two adjacent spectral bands into a pair-wise descriptor code that is based on a probability distribution of quantized characteristics of the adjacent spectral bands;

encoding the vector quantized indices; and forming a bitstream of the encoded codebook indices and encoded vector quantized indices to represent the quantized transform spectrum.

2. The method of claim 1, wherein the DCT-type transform layer is a Modified Discrete Cosine Transform (MDCT) layer and the transform spectrum is an MDCT spectrum.

3. The method of claim 1, further comprising:

dropping a set of spectral bands to reduce the number of spectral bands prior to encoding.

4. The method of claim 1, wherein encoding the at least two adjacent spectral bands includes scanning adjacent pairs of spectral bands to ascertain their characteristics;

identifying a codebook index for each of the spectral bands;

obtaining a descriptor component and an extension code component for each codebook index.

5. The method of claim 4, further comprising:

encoding a first descriptor component and a second descriptor component in pairs to obtain the pair-wise descriptor code.

6. The method of claim 4, wherein the pair-wise descriptor code maps to one of a plurality of possible variable length codes (VLC) for different codebooks.

7. The method of claim 6, wherein VLC codebooks are assigned to each pair of descriptor components based on a relative position of each corresponding spectral band within an audio frame and an encoder layer number.

8. The method of claim 7, wherein the pair-wise descriptor codes are based on a quantized set of typical probability distributions of descriptor values in each pair of descriptors.

9. The method of claim 4, wherein a single descriptor component is utilized for codebook indices greater than a value k, and extension code components are utilized for codebook indices greater than the value k.

10. The method of claim 4, wherein each codebook index is associated a descriptor component that is based on a statistical analysis of distributions of possible codebook indices, with codebook indices having a greater probability of being selected being assigned individual descriptor components and codebook indices having a smaller probability of being selected being grouped and assigned to a single descriptor.

11. A scalable speech and audio encoder device, comprising:

a Discrete Cosine Transform (DCT)-type transform layer module adapted to obtain a residual signal from a Code Excited Linear Prediction (CELP)-based encoding layer, where the residual signal is a difference between an original audio signal and a reconstructed version of the original audio signal, wherein the Discrete Cosine Transform (DCT)-type transform layer module is further adapted to transform the residual signal at a Discrete Cosine Transform (DCT)-type transform layer to obtain a corresponding transform spectrum;

a band selector for dividing the transform spectrum into a plurality of spectral bands, each spectral band having a plurality of spectral lines;

a codebook selector for selecting a plurality of different codebooks for encoding the spectral bands, where the codebooks have associated codebook indices;

a vector quantizer for performing vector quantization on spectral lines in each spectral band using the selected codebooks to obtain vector quantized indices;

a codebook indices encoder for encoding a plurality of codebooks indices together, wherein the codebooks indices encoder includes is adapted to encode codebook indices for at least two adjacent spectral bands into a pair-wise descriptor code that is based on a probability distribution of quantized characteristics of the adjacent spectral bands;

a vector quantized indices encoder for encoding the vector; and a transmitter for transmitting a bitstream of the encoded codebook indices and encoded vector quantized indices to represent the quantized transform spectrum.

12. The device of claim 11, wherein the DCT-type transform layer module is a Modified Discrete Cosine Transform (MDCT) layer module and the transform spectrum is an MDCT spectrum.

13. The device of claim 11, wherein the codebook selector is adapted to scan adjacent pairs of spectral bands to ascertain their characteristics, and further comprising:

a codebook index identifier for identifying a codebook index for each of the spectral bands; and a descriptor selector module for obtaining a descriptor component and an extension code component for each codebook index.

14. The device of claim 11, wherein the pair-wise descriptor code maps to one of a plurality of possible variable length codes (VLC) for different codebooks.

15. The device of claim 14, wherein VLC codebooks are assigned to each pair of descriptor components based on a relative position of each corresponding spectral band within an audio frame and an encoder layer number.

16. A scalable speech and audio encoder device, comprising:

means for obtaining a residual signal from a Code Excited Linear Prediction (CELP)-based encoding layer, where the residual signal is a difference between an original audio signal and a reconstructed version of the original audio signal;

means for transforming the residual signal at a Discrete Cosine Transform (DCT)-type transform layer to obtain a corresponding transform spectrum;

means for dividing the transform spectrum into a plurality of spectral bands, each spectral band having a plurality of spectral lines;

means for selecting a plurality of different codebooks for encoding the spectral bands, where the codebooks have associated codebook indices;

means for performing vector quantization on spectral lines in each spectral band using the selected codebooks to obtain vector quantized indices;

means for encoding the codebook indices, wherein encoding the codebooks indices includes encoding at least two adjacent spectral bands into a pair-wise descriptor code that is based on a probability distribution of quantized characteristics of the adjacent spectral bands;

means for encoding the vector quantized indices; and means for forming a bitstream of the encoded codebook indices and encoded vector quantized indices to represent the quantized transform spectrum.

17. A non-transitory machine-readable medium comprising instructions operational for scalable speech and audio encoding, which when executed by one or more processors causes the processors to:

obtain a residual signal from a Code Excited Linear Prediction (CELP)-based encoding layer, where the residual signal is a difference between an original audio signal and a reconstructed version of the original audio signal;

transform the residual signal at a Discrete Cosine Transform (DCT)-type transform layer to obtain a corresponding transform spectrum;

divide the transform spectrum into a plurality of spectral bands, each spectral band having a plurality of spectral lines;

select a plurality of different codebooks for encoding the spectral bands, where the codebooks have associated codebook indices;

perform vector quantization on spectral lines in each spectral band using the selected codebooks to obtain vector quantized indices;

encode the codebook indices, wherein encoding the codebooks indices includes encoding at least two adjacent spectral bands into a pair-wise descriptor code that is based on a probability distribution of quantized characteristics of the adjacent spectral bands;

encode the vector quantized indices; and form a bitstream of the encoded codebook indices and encoded vector quantized indices to represent the quantized transform spectrum.

18. A method for decoding in a scalable speech and audio codec, comprising:

obtaining a bitstream having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer, wherein the plurality of encoded codebook indices are represented by a pair-wise descriptor code representing a plurality of adjacent transform spectrum spectral bands of an audio frame;

decoding the plurality of encoded codebook indices to obtain decoded codebook indices for a plurality of spectral bands;

decoding the plurality of encoded vector quantized indices to obtain decoded vector quantized indices for the plurality of spectral bands; and synthesizing the plurality of spectral bands using the decoded codebook indices and decoded vector quantized indices to obtain a reconstructed version of the residual signal at an Inverse Discrete Cosine Transform (IDCT)-type inverse transform layer.

19. The method of claim 18, wherein the IDCT-type transform layer is an Inverse Modified Discrete Cosine Transform (IMDCT) layer and the transform spectrum is an IMDCT spectrum.

20. The method of claim 18, wherein decoding the plurality of encoded codebook indices includes obtaining a descriptor component corresponding to each of the plurality of spectral bands;

obtaining an extension code component corresponding to each of the plurality of spectral bands;

obtaining a codebook index component corresponding to each of the plurality of spectral bands based on the descriptor component and extension code component; and utilizing the codebook index to synthesize a spectral band for each corresponding to each of the plurality of spectral bands.

21. The method of claim 20 wherein the descriptor component is associated with a codebook index that is based on a statistical analysis of distributions of possible codebook indices, with codebook indices having a greater probability of being selected being assigned individual descriptor components and codebook indices having a smaller probability of being selected being grouped and assigned to a single descriptor.

22. The method of claim 21, wherein a single descriptor component is utilized for codebook indices greater than a value k, and extension code components are utilized for codebook indices greater than the value k.

23. The method of claim 18, wherein the pair-wise descriptor code is based on a probability distribution of quantized characteristics of the adjacent spectral bands.

24. The method of claim 18, wherein the pair-wise descriptor code maps to one of a plurality of possible variable length codes (VLC) for different codebooks.

25. The method of claim 24, wherein VLC codebooks are assigned to each pair of descriptor components is based on a relative position of each corresponding spectral band within the audio frame and an encoder layer number.

26. The method of claim 18, wherein pair-wise descriptor codes are based on a quantized set of typical probability distributions of descriptor values in each pair of descriptors.

27. A scalable speech and audio decoder device, comprising:

a receiver to obtain a bitstream having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer, wherein the plurality of encoded codebook indices are represented by a pair-wise descriptor code representing a plurality of adjacent transform spectrum spectral bands of an audio frame;

a codebook index decoder for decoding the plurality of encoded codebook indices to obtain decoded codebook indices for a plurality of spectral bands;

a vector quantized index decoder for decoding the plurality of encoded vector quantized indices to obtain decoded vector quantized indices for the plurality of spectral bands; and a band synthesizer for synthesizing the plurality of spectral bands using the decoded codebook indices and decoded vector quantized indices to obtain a reconstructed version of the residual signal at an Inverse Discrete Cosine Transform (IDCT)-type inverse transform layer.

28. The device of claim 27, wherein the IDCT-type transform layer module is an Inverse Modified Discrete Cosine Transform (IMDCT) layer module and the transform spectrum is an IMDCT spectrum.

29. The device of claim 27, further comprising:

a descriptor identifier module for obtaining a descriptor component corresponding to each of the plurality of spectral bands;

an extension code identifier for obtaining an extension code component corresponding to each of the plurality of spectral bands;

a codebook index identifier for obtaining a codebook index component corresponding to each of the plurality of spectral bands based on the descriptor component and extension code component; and a codebook selector that utilizes the codebook index and a corresponding vector quantized index to synthesize a spectral band for each corresponding to each of the plurality of spectral bands.

30. The device of claim 27, wherein the pair-wise descriptor code is based on a probability distribution of quantized characteristics of the adjacent spectral bands.

31. The device of claim 27, wherein pair-wise descriptor codes are based on a quantized set of typical probability distributions of descriptor values in each pair of descriptors.

32. A scalable speech and audio decoder device, comprising:

means for obtaining a bitstream having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer, wherein the plurality of encoded codebook indices are represented by a pair-wise descriptor code representing a plurality of adjacent transform spectrum spectral bands of an audio frame;

means for decoding the plurality of encoded codebook indices to obtain decoded codebook indices for a plurality of spectral bands;

means for decoding the plurality of encoded vector quantized indices to obtain decoded vector quantized indices for the plurality of spectral bands; and means for synthesizing the plurality of spectral bands using the decoded codebook indices and decoded vector quantized indices to obtain a reconstructed version of the residual signal at an Inverse Discrete Cosine Transform (IDCT)-type inverse transform layer.

33. A non-transitory machine-readable medium comprising instructions operational for scalable speech and audio decoding, which when executed by one or more processors causes the processors to:

obtain a bitstream having a plurality of encoded codebook indices and a plurality of encoded vector quantized indices that represent a quantized transform spectrum of a residual signal, where the residual signal is a difference between an original audio signal and a reconstructed version of the original audio signal from a Code Excited Linear Prediction (CELP)-based encoding layer, wherein the plurality of encoded codebook indices are represented by a pair-wise descriptor code representing a plurality of adjacent transform spectrum spectral bands of an audio frame;

decode the plurality of encoded codebook indices to obtain decoded codebook indices for a plurality of spectral bands;

decode the plurality of encoded vector quantized indices to obtain decoded vector quantized indices for the plurality of spectral bands; and synthesize the plurality of spectral bands using the decoded codebook indices and decoded vector quantized indices to obtain a reconstructed version of the residual signal at an Inverse Discrete Cosine Transform (IDCT)-type inverse transform layer.

* * * * *